US007073528B2

(12) United States Patent
Kempf et al.

(10) Patent No.: US 7,073,528 B2
(45) Date of Patent: Jul. 11, 2006

(54) WATER PUMP AND THERMOSTATICALLY CONTROLLED BYPASS VALVE

(75) Inventors: Dale Kempf, Clovis, CA (US); Ken Lum, Fresno, CA (US)

(73) Assignee: Grundfos Pumps Manufacturing Corp., Fresno, CA (US)

( * ) Notice: Subject to any disclaimer, the term of this patent is extended or adjusted under 35 U.S.C. 154(b) by 521 days.

(21) Appl. No.: 10/394,795

(22) Filed: Mar. 21, 2003

(65) Prior Publication Data

US 2003/0140966 A1 Jul. 31, 2003

Related U.S. Application Data

(63) Continuation-in-part of application No. 10/006,970, filed on Dec. 4, 2001, now Pat. No. 6,929,187, which is a continuation-in-part of application No. 09/697, 520, filed on Oct. 25, 2000, now Pat. No. 6,536,464.

(51) Int. Cl.
*F16K 49/00* (2006.01)

(52) U.S. Cl. ..... 137/337; 236/12.11; 236/93 A; 122/13.3; 4/638; 4/732

(58) Field of Classification Search ..... 137/337; 236/12.11; 122/13.3; 4/638, 732
See application file for complete search history.

(56) References Cited

U.S. PATENT DOCUMENTS

| | | | |
|---|---|---|---|
| 2,716,424 | A | 8/1955 | Watts |
| 2,833,695 | A | 5/1958 | Kooi |
| 2,842,155 | A | 7/1958 | Peters |
| 3,543,836 | A | 12/1970 | Paulson et al. |
| 3,741,195 | A | 6/1973 | Ellis |
| 4,142,515 | A | 3/1979 | Skaats |
| 4,321,943 | A | 3/1982 | Haws |
| 4,331,292 | A | 5/1982 | Zimmer |
| 4,606,325 | A | 8/1986 | Lujan, Jr. |
| 5,119,988 | A | 6/1992 | Fiedrich |
| 5,135,021 | A | 8/1992 | Pegg |
| 5,183,029 | A | 2/1993 | Ranger |
| 5,209,401 | A | 5/1993 | Fiedrich |
| 5,261,443 | A | 11/1993 | Walsh |
| 5,287,570 | A | 2/1994 | Peterson et al. |
| 5,323,803 | A | 6/1994 | Blumenauer |

(Continued)

OTHER PUBLICATIONS

The Blumenauer Corporation Aqualink®, Why Wait for HOT Water?; Apr. 19, 2001; 4 pages, 2004.

(Continued)

*Primary Examiner*—A. Michael Chambers
(74) *Attorney, Agent, or Firm*—Armstrong Teasdale, LLP; Dean D. Small

(57) ABSTRACT

A water control valve configured for use with a bypass valve to automatically bypass cold or tepid water in a hot water supply line so as to maintain hot water at the fixture. The water control valve is useful for shower/tub facilities and for appliances such as washing machines and dishwashing machines. The water control valve for use with shower/tub facilities is adapted for the bypass valve to attach to or be adjacent to the water control valve by utilizing bypass ports, passageways and/or connectors. The water control valve for use with appliances is adapted to have a second outlet for connecting to a second water control valve or, for combination service valves, to have the bypass valve disposed in the tubular section between the hot and cold water components. The preferred bypass valve is a thermostatically controlled bypass valve of the type having a thermal actuating element.

40 Claims, 20 Drawing Sheets

U.S. PATENT DOCUMENTS

| | | | |
|---|---|---|---|
| 5,572,985 | A | 11/1996 | Benham |
| 5,623,990 | A | 4/1997 | Pirkle |
| 5,819,785 | A | 10/1998 | Bardini |
| 5,829,467 | A | 11/1998 | Spicher |
| 5,873,518 | A | 2/1999 | Richmond et al. |

OTHER PUBLICATIONS

The Blumenauer Corporation Aqualink, How it Works; Apr. 19, 2001; 2 pages, 2004.

The Blumenauer Corporation, Aqua-Heat Hot water recirculating system; 4 pages, 2004.

Laing Autocirc® *Undersink Automatic Instant Hot Water Delivery System*; Model ACT-303-BTW; 2 pages, 2004.

Laing Autocirc®; Model No: ACT-303-BTW; Economic Study; 3 pages, 2004.

LAING Instant Hot Water Delivery Systems; Autocirc™ Questions & Answers; 3 pages, 2004.

METLUND® (S-46, S01, and S02) PreFab Systems; S-Series HOt Water D'Mand® Systems For Standard Piping (non-recirc); Installation and Operating Instructions; 7 pages, 2004.

Metlund® D'Mand® Systems; Got Hot Water? 2 Pages, 2004.

Jim Dulley, Update Bulletin No. 991, 2001, 4 pages, 2004.

Metlund Systems, Advanced Conservation Technology, Inc., 16 pages, 2004.

Medlund Systems, Easy Installation Instructions, 10 pages, 2004.

Medlund Systems, Energy Technology Status Report—E.T.S.R., 11 pages, 2004.

Medlund Systems, Online Ordering, Purchasing Tips, 2 pages, 2004.

Grundfos Hot Water Recirculation Product and Application Guide, 10 pages, 2004.

NIBCO.com: Just Right, Hot Water In Seconds!, 10 pages, 2004.

The Chilipepper Hot Water Appliance, How to Get FASTER Hot Water!!!, 22 pages, 2004.

Installation and Operating Instructions for the Chilipepper Appliance, 2 pages, 2004.

WATER PUMP AND THERMOSTATICALLY CONTROLLED BYPASS VALVE

CROSS REFERENCE TO RELATED APPLICATIONS

This application is a continuation-in-part of U.S. patent application Ser. No. 10/006,970 filed Dec. 4, 2001, (now U.S. Pat. No. 6,929,187) which is a continuation-in-part of U.S. patent application Ser. No. 09/697,520 filed Oct. 25, 2000 (now U.S. Pat. No. 6,536,464).

BACKGROUND OF THE INVENTION

1. Field of the Invention

The present invention relates generally to water control valves for use in home or industrial water distribution systems that supply water to various fixtures at different temperatures through different pipe systems. More specifically, the present invention relates to such water control valves that are adaptable for use with a bypass valve so as to bypass cold or tepid water away from the associated fixture until it reaches the desired temperature. The present invention is particularly useful for providing a water control valve having a bypass valve which is accessible through the support wall associated with the fixture and which can also be used with non-working or service valves.

2. Background

Home and industrial water distribution systems distribute water to various fixtures, including sinks, bathtubs, showers, dishwashers and washing machines, that are located throughout the house or industrial building. The typical water distribution system brings water in from an external source, such as a city main water line or a private water well, to the internal water distribution piping system. The water from the external source is typically either at a cold or cool temperature. One segment of the piping system takes this incoming cold water and distributes it to the various cold water connections located at the fixtures where it will be used (i.e., the cold water side of the faucet at the kitchen sink). Another segment of the piping system delivers the incoming cold water to a water heater which heats the water to the desired temperature and distributes it to the various hot water connections where it will be used (i.e., the hot water side of the kitchen faucet). At the fixture, cold and hot water either flows through separate hot and cold water control valves that are independently operated to control the temperature of the water into the fixture by controlling the flow rate of water from the separate valves or the water is mixed at a single valve that selectively controls the desired water temperature flowing from the fixture.

A well known problem with most home and industrial water distribution systems is that hot water is not always readily available at the hot water side of the fixture when it is desired. This problem is particularly acute in water use fixtures that are located a distance from the hot water heater or in systems with poorly insulated pipes. When the hot water side of these fixtures is left closed for some time, such as overnight, the hot water in the hot water segment of the piping system sits in the pipes and cools. As a result, the temperature of the water between the hot water heater and the fixture lowers until it becomes cold or at least tepid. When opened again, it is not at all uncommon for the hot water side of such a fixture to supply cold water through the hot water valve when it is first opened and for some time thereafter. At the sink, bathtub or shower fixture located away from the water heater, the person desiring to use the fixture will either have to use cold or tepid water instead of hot water or wait for the distribution system to supply hot water through the open hot water valve. Most users have learned that to obtain the desired hot water, the hot water valve must be opened and left open for some time so that the cool water in the hot water side of the piping system will flow out ahead of the hot water. For certain fixtures, such as virtually all dishwashers and washing machines (which are not usually provided with a bypass valve), there typically is no method of "draining" away the cold or tepid water in the hot water pipes prior to utilizing the water in the fixture.

The inability to have hot water at the hot water side of the fixture when it is desired creates a number of problems. One problem is having to utilize cold or tepid water when hot water is desired. This is a particular problem for the dishwasher and washing machine fixtures in that hot water is often desired for improved operation of those appliances. As is well known, certain dirty dishes and clothes are much easier to clean in hot water as opposed to cold or tepid water. Even in those fixtures where the person can let the cold or tepid water flow out of the fixture until it reaches the desired warm or hot temperature, there are certain problems associated with such a solution. One such problem is the waste of water that flows out of the fixture through the drain and, typically, to the sewage system. This good and clean water is wasted (resulting in unnecessary water treatment after flowing through the sewage system). This waste of water is compounded when the person is inattentive and hot water begins flowing down the drain and to the sewage system. Yet another problem associated with the inability to have hot water at the hot water valve when needed is the waste of time for the person who must wait for the water to reach the desired temperature.

The use of bypass valves and/or water recirculation systems in home or industrial water distribution systems to overcome the problems described above have been known for some time. The objective of the bypass valve or recirculation system is to avoid supplying cold or tepid water at the hot water side of the piping system. U.S. Pat. No. 2,842,155 to Peters describes a thermostatically controlled water bypass valve, shown as FIG. 2 therein, that connects at or near the fixture located away from the water heater. The inventor discusses the problems of cool "hot" water and describes a number of prior art attempts to solve the problem. The bypass valve in the Peters patent comprises a cylindrical housing having threaded ends that connect to the hot and cold water piping at the fixture so as to interconnect these piping segments. Inside the housing at the hot water side is a temperature responsive element having a valve ball at one end that can sealably abut a valve seat. The temperature responsive element is a metallic bellows that extends when it is heated to close the valve ball against the valve seat and contracts when cooled to allow water to flow from the hot side to the cold side of the piping system when both the hot and cold water valves are closed. Inside the housing at the cold water side is a dual action check valve that prevents cold water from flowing to the hot water side of the piping system when the hot water valve or the cold water valve is open. An alternative embodiment of the Peters' invention shows the use of a spiral temperature responsive element having a finger portion that moves left or right to close or open the valve between the hot and cold water piping segments. Although the invention described in the Peters' patent relies on gravity or convection flow, similar systems utilizing pumps to cause a positive circulation are increasingly known. These pumps are typically placed in the hot water line in close proximity to the fixture where "instant" hot water is desired.

U.S. Pat. No. 5,623,990 to Pirkle describes a temperature-controlled water delivery system for use with showers and eye-wash apparatuses that utilize a pair of temperature responsive valves, shown as FIGS. 2 and 5 therein. These valves utilize thermally responsive wax actuators that push valve elements against springs to open or close the valves to allow fluid of certain temperatures to pass. U.S. Pat. No. 5,209,401 to Fiedrich describes a diverting valve for hydronic heating systems, best shown in FIGS. 3 through 5, that is used in conjunction with a thermostatic control head having a sensor bulb to detect the temperature of the supply water. U.S. Pat. No. 5,119,988 also to Fiedrich describes a three-way modulating diverting valve, shown as FIG. 6. A non-electric, thermostatic, automatic controller provides the force for the modulation of the valve stem against the spring. U.S. Pat. No. 5,287,570 to Peterson et al. discloses the use of a bypass valve located below a sink to divert cold water from the hot water faucet to the sewer or a water reservoir. As discussed with regard to FIG. 5, the bypass valve is used in conjunction with a separate temperature sensor.

Recirculating systems for domestic and industrial hot water heating utilizing a bypass valve is disclosed in U.S. Pat. No. 5,572,985 to Benham and U.S. Pat. No. 5,323,803 to Blumenauer. The Benham system utilizes a circulating pump in the return line to the water heater and a temperature responsive or thermostatically actuated bypass valve disposed between the circulating pump and the hot water heater to maintain a return flow temperature at a temperature level below that at the outlet from the water heater. The bypass valve, shown in FIG. 2, utilizes a thermostatic actuator that extends or retracts its stem portion, having a valve member at its end, to seat or unseat the valve. When the fluid temperature reaches the desired level, the valve is unseated so that fluid that normally circulates through the return line of the system is bypassed through the circulating pump. The Blumenauer system utilizes an instantaneous hot water device comprising a gate valve and ball valve in a bypass line interconnecting the hot and cold water input lines with a pump and timer placed in the hot water line near the hot water heater.

Despite the devices and systems set forth above, many people still have problems with obtaining hot water at the hot water side of fixtures located away from the hot water heater or other source of hot water. Boosted, thermally actuated valve systems having valves that are directly operated by a thermal actuator (such as a wax filled cartridge) tend not to have any toggle action. Instead, after a few on-off cycles, the valves tend to just throttle the flow until the water reaches an equilibrium temperature, at which time the valve stays slightly cracked open. While this meets the primary function of keeping the water at a remote fixture hot, leaving the valve in a slightly open condition does present two problems. First, the lack of toggle action can result in scale being more likely to build up on the actuator because it is constantly extended. Second, the open valve constantly bleeds a small amount of hot or almost hot water into the cold water piping, thereby keeping the faucet end of the cold water pipe substantially warm. If truly cold water is desired (i.e., for brushing teeth, drinking, or making cold beverages), then some water must be wasted from the cold water faucet to drain out the warm water. If the bypass valve is equipped with a spring loaded check valve to prevent siphoning of cold water into the hot water side when only the hot water faucet is open, then the very small flow allowed through the throttled-down valve may cause chattering of the spring loaded check valve. The chattering can be avoided by using a free floating or non-spring loaded check valve. It is also detrimental to have any noticeable crossover flow (siphoning) from hot to cold or cold to hot with any combination of faucet positions, water temperatures, or pump operation.

Co-pending U.S. patent application Ser. No. 09/697,520, now U.S. Pat. No. 6,536,464, the disclosure of which is incorporated herein as though fully set forth and having some of the same inventors and the same assignee as the present invention, describes an under-the-sink thermostatically controlled bypass valve and water circulating system with the bypass valve placed at or near a fixture (i.e., under the sink) to automatically bypass cold or tepid water away from the hot water side of the fixture until the temperature of the water reaches the desired level. Co-pending U.S. patent application Ser. No. 10/006,970, now U.S. Pat. No. 6,929,187, the disclosure of which is also incorporated herein as though fully set forth and having the same inventors and the same assignee as the present invention, describes a water control fixture having a thermostatically controlled bypass valve integral with the fixture, either in a separate chamber or in the operating valve, for bypassing cold or tepid water away from the hot side of the fixture. Preferably, both of the above-mentioned bypass devices utilize a thermal actuator element that is thermally responsive to the temperature of the water to automatically control the diversion of water from the fixture, so as to maintain hot water availability at the hot water side of the fixture.

Certain water control fixtures, such as those used with most bath and shower systems, are incorporated into a support wall such that the user water control handles and discharge faucets/heads protrude from an opening in the wall. Typically, the wall opening is completely covered by a plate, referred to as an escutcheon plate, such that the water control valve is located behind the wall. When it is necessary to repair or replace the water control valve, the plate is removed to allow access to the valve components located behind the wall. Another type of water control valve is the service-type of valve, such as the angle stop valves, that protrude from the wall in pairs (one each for the cold and hot lines) to connect to a sink, washing machine, dishwasher or like devices. The service-type valves typically comprise a manually operated handle that is used, somewhat infrequently, to open or close the valve. The service valves are generally left in the open position to allow hot and cold water to flow to the fixture and are only closed to shut off the flow of water in order to service or replace the fixture.

Due to the nature of their use, shower/tub fixtures and fixtures connected to service valves are the most common problem areas with regard to the availability of hot water and, as such, can benefit greatly from the use of a bypass valve, such as a thermostatically controlled bypass valve. With regard to shower/tub valves, it is very desirable that the bypass valve be located behind the support wall with the water control valve. As with the water control valve itself, the bypass valve must be accessible through the same opening in the support wall used to service the water control valve so as to allow any necessary cleaning, repair or replacement of the bypass valve. With service valves, it is desirable for the bypass valve to be located at or near where the service valve exits the support wall to ease installation and service of the bypass valve. None of the known prior art devices include the use of a bypass valve to bypass water from the shower or related water control fixture that is accessible through the opening in the support wall or which interconnects the pair of service valves connected to a fixture, as described above.

SUMMARY OF THE INVENTION

The water control valve adapted for use with a bypass valve, particularly a thermostatically controlled bypass valve, of the present invention solves the problems and provides the benefits identified above. That is to say, the present invention provides a water control valve adapted for use with bypass valves, including thermostatically controlled bypass valves, to automatically bypass cold or tepid water away from the hot water side of the fixture while the temperature of the water is below the desired level so as to maintain hot water for use at the fixture. The water control valve of the present invention is particularly useful for water control fixtures having the water control valve located at least partially behind the support wall. The thermostatically controlled bypass valve of the present invention is adaptable to a wide variety of water control valves and valve designs. A single small circulating pump can be placed between the water heater and the first branching in the hot water supply line which supplies a water control valve having a bypass valve to pressurize the hot water piping system and facilitate bypassing of the cold or tepid water.

For purposes of this disclosure, the terms "integral," "attached," "adjacent," "included," and "remote" pertain to the location of a bypass valve with respect to the final or working water control valve (which is the mixing valve at the water control fixture, as opposed to the selector valve that diverts mixed water from the bathtub to the shower or from the fixed shower head to a hand-held shower head, or to service valves). More specifically, the terms "integral," "attached," and "adjacent" refer to the location of a bypass valve such that it is reachable for service by way of the same access as is used for service of the final or working water control valve. As example, the access commonly available to service a shower valve is by way of the hole through the shower (i.e., support) wall surrounding the shower control valve stem with the escutcheon plate removed or in a kitchen, lavatory, bar and other such locations, by way of the space above and surrounding the water control fixture. In addition to location regarding serviceability, the terms "integral," "attached" and "adjacent" are further defined as to the mechanism of physical support and hydraulic connection of the bypass valve to or within the working water control valve. The term "remote" refers to the location of the bypass valve that is not reachable from the normal access approach to the final or working water control valve or appliance (i.e., such as the undersink bypass valve described in co-pending U.S. patent application Ser. No. 09/697,520). The term "included" refers to a bypass valve which is integrated with or is appended to a remote angle stop service valve or other "non-working" remote service valve.

For purposes of this disclosure, the term "integral" is further defined to include the following concepts: (1) the bypass valve is incorporated within the water control valve inner workings, such as the replaceable valve ball or cartridge used in most modern water control valves; (2) the bypass valve is separate from the water control valve inner workings but is within and accessible from the same cavity containing the water control valve workings, such as can be achieved by making the cartridge bore longer to accommodate the bypass valve; and (3) the bypass valve is separate from the water control valve inner workings and is located in a separate cavity within the water control valve's housing. Examples of integral bypass valve configurations are described in co-pending U.S. patent application Ser. No. 10/006,970. The term "attached" is further defined to include the following concepts: (1) an external bypass valve supported from the water control valve housing with rigid hot and cold water connections/conduits thereto for a bypass valve having a single port connection with only one seal to atmosphere and separate sealing mechanisms for the hot and cold connection within the single atmospheric seal, or a bypass valve having two distinct externally accessible ports for hot and cold connections, each having a seal to atmosphere; and (2) an external bypass valve rigidly supported from the water control valve housing or its communicating plumbing and communicating to hot and cold water ports thereon with flexible or conformable connections and/or saddle valves. The term "adjacent" is further defined to include the concept of an external and separate bypass valve reachable for service by way of the same access as is used for service of the final or working water control valve but which is not rigidly supported by plumbing or other attachment to the water control valve housing or its communicating plumbing. The hot and cold bypass conduits may be connected to the water control valve housing or to supply plumbing attached thereto and such conduits may be compliant, conformable or flexible and have various conventional connecting mechanisms, including saddle valves.

In one primary embodiment of the present invention, the water control valve is shower and/or bathtub valve that is adapted to attach to or which includes a bypass valve. Although a variety of bypass valves may be used, the preferred embodiment utilizes a thermostatically controlled bypass valve having a thermally sensitive actuating element, such as a wax-filled cartridge actuator, to automatically bypass cold or tepid water past the shower/tub valve so as to maintain hot water at the fixture. The bypass valve is sized and configured to be accessible through the same opening in the support wall utilized to service or replace the water control valve. In the preferred embodiment, the water control valve manifold is adapted to have a hot water port and a cold water port, each of which are connected to the respective hot and cold water inputs by internal passageways. The preferred embodiment also incorporates a screen disposed in the water control valve so as to keep debris out of the bypass valve and to be self-cleaning. The preferred actuating element has an actuating body and a rod member, the rod member being configured to operatively extend from the actuating body to seal against a passage located in the separating wall to prevent water flow through the passage. A bias spring is located in the bypass valve body to urge the rod member toward the actuating body so as to open the passage. A check valve can be used to prevent flow of water from the cold water side to the hot water side.

The present invention also describes a water control valve having an external port adapted to connect to a bypass valve that connects with another water control valve having an external port that is adapted to connect to the bypass valve. Alternatively, the bypass valve can be included with a pair of water control valves, such as service valves, for selectively supplying water to a fixture, including a sink, washing machine, dishwasher and the like. Although a variety of bypass valves may be used, the preferred embodiment utilizes a thermostatically controlled bypass valve as described above.

The present invention also describes a water circulating system for distributing water to a water control fixture that is configured for utilizing hot and cold water from a hot water inlet and a cold water inlet. A hot water heater supplies hot water to the fixture through the hot water piping system that interconnects the hot water heater with the hot water inlet at the fixture. The system also has a source of cold water, such as the city water supply or a local well, for supplying cold water to the fixture through the cold water piping system that interconnects the source of cold water with the cold water inlet at the fixture. The source of cold water also supplies water to the hot water heater for distribution through the hot water piping system. As such, when the bypass valve located at the fixture is bypassing water the hot and cold water circulating systems form a loop. A water control valve having or connected to a bypass valve interconnects the hot water piping system to the hot water inlet and the cold water piping system to the cold water inlet. The bypass valve is configured to bypass water from the hot water piping system to the cold water piping system until the water in the hot water piping system rises to a preset temperature value, thereby maintaining hot water at the fixture. Preferably, the bypass valve is a thermostatically controlled bypass valve that automatically bypasses cold or tepid water. A single, small pump can be used in the hot water piping system to pump water through the hot water line to the hot water inlet at the water control valve. In the preferred embodiment, the single pump is a low flow and low head pump. If necessary, a check valve can be used to pass water around the pump when the flow rate in the hot water line exceeds the flow rate capacity of the pump. An orifice can be located in the discharge of the pump to achieve the desired steep flow-head curve from standard pumps. A mechanism for cyclically operating the pump can be used to reduce electrical demand and wear and tear on the pump and bypass valve. In addition, a flow switch can be connected to the pump for detecting the flow rate of the water in the hot water line and for shutting off the pump when the flow exceeds the flow rate capacity of the bypass valve.

Accordingly, the primary objective of the present invention is to provide a water control valve adaptable for attachment to or included with a bypass valve that is configured for bypassing water from a hot water piping system to a cold water piping system at a water control valve until the temperature of the water in the hot water piping system is at the desired level.

It is also an important objective of the present invention to provide a water control valve adaptable for attachment to or included with a thermostatically controlled bypass valve to automatically bypass water from a fixture so as to maintain hot water at the fixture.

It is also an important objective of the present invention to provide a water control valve adaptable for attachment to or included with a bypass valve that is accessible through the same opening in a support wall used to service or replace the water control valve.

It is also an important objective of the present invention to provide a water control valve for a fixture that is adaptable for attachment to or included with a bypass valve that is also adaptable for attachment to or included with another water control valve supplying water to the same fixture.

It is also an important objective of the present invention to provide a water control valve adaptable for attachment to or included with a thermostatically controlled bypass valve that utilizes a thermally sensitive actuating element having a rod member configured to operatively open and close a passage between the hot and cold sides of the bypass valve based on the temperature of the water at the fixture.

It is also an important objective of the present invention to provide a water control valve having a thermostatically controlled bypass valve that includes a check valve therein to prevent the flow of water from the cold water piping system to the hot water piping system when the bypass water is cold and the bypass valve is open.

It is also an important objective of the present invention to provide a water circulating system utilizing a water control valve attached to or included with a bypass valve, such as a thermostatically controlled bypass valve, and a pump in the hot water piping system to circulate water from the hot water piping system to the cold water piping system through the bypass valve until the temperature of the water in the hot water piping system reaches a preset level.

It is also an objective of the present invention to provide a water control valve adapted for attachment to or included with a bypass valve that is suitable for a wide variety of fixtures.

BRIEF DESCRIPTION OF THE DRAWINGS

In the drawings which illustrate the best modes presently contemplated for carrying out the present invention.

DETAILED DESCRIPTION OF THE INVENTION THE PREFERRED EMBODIMENT

With reference to the figures where like elements have been given like numerical designations to facilitate the reader's understanding of the present invention, the preferred embodiments of the present invention are set forth below. The enclosed figures and drawings are illustrative of the preferred embodiments and represent a preferred way of configuring the present invention. Although specific components, materials, configurations and uses are illustrated, it should be understood that a number of variations to the components and to the configuration of those components described herein and in the accompanying figures can be made without changing the scope and function of the invention set forth herein.

In the accompanying drawings of the various preferred embodiments of a water control valve of the present invention, the water control valves are shown as a tub/shower valve 10, separate service valves 12 and a combined service valve 14, best shown in FIGS. 5–8, 10–13 and 15–18. However, other water control valves may be adaptable to a bypass valve, including a thermostatically controlled bypass valve, as described herein (i.e., valves used on washing machines, dishwashers and other fixtures). The bypass valve, shown generally as 16 in the accompanying figures, that is attached to or included with the water control valves of the present invention can be one of many different types of available bypass valves, including thermostatically controlled bypass valves (as shown in the co-pending patent applications referenced above), electric solenoid controlled bypass valves, needle-type bypass valves as described in the above-referenced Blumenauer patent or mechanical push button bypass valves such as sold by Laing and others. The water control valves of the present invention are adaptable for use with the various types of bypass valves by being attached, adjacent or included with the water control valve, as described in more detail below.

Figure 1:
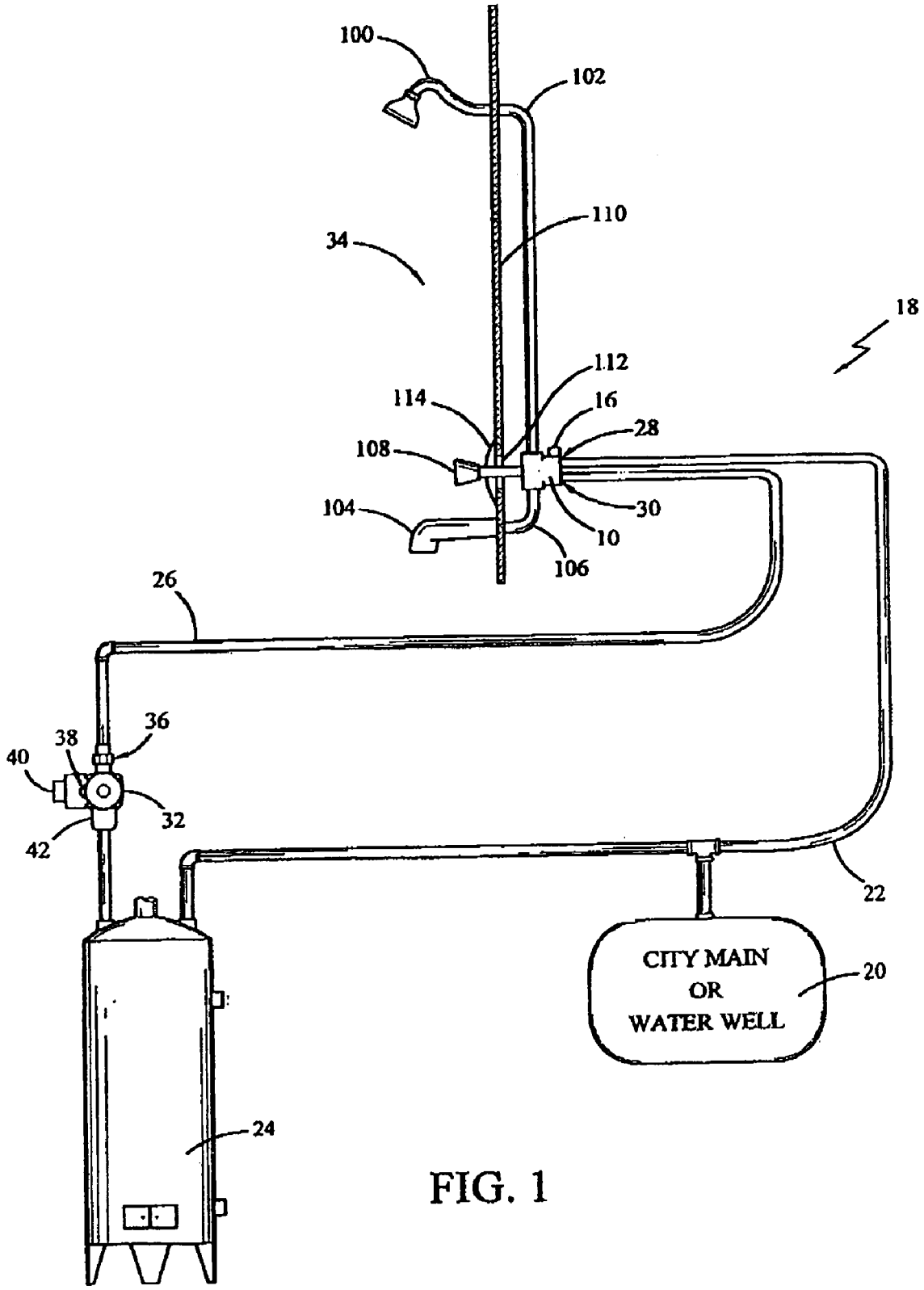
FIG. 1 shows a water distribution system utilizing a water control valve of the present invention having a bypass valve in a shower/tub assembly.

A typical water distribution system 18 utilizing a tub/shower water control valve 10 of the present invention is illustrated in FIG. 1. The water distribution system 18 typically comprises a supply of cold water 20, such as from a city main or water well, that supplies cold water directly to water control valve 10 through cold water line 22 and water to hot water heater 24 so that it may heat the water and supply hot water to water control valve 10 through hot water line 26. Cold water line 22 connects to water control valve 10 at cold water inlet 28 and hot water line 26 connects to water control valve 10 at hot water inlet 30, as explained in more detail below. The preferred system 18 of the present invention utilizes a small circulating pump 32 of the type used in residential hot water space heating. A very low flow and low head pump 32 is desirable because a larger (i.e., higher head/higher flow) pump mounted at the typical domestic water heater 24 tends to be noisy. This annoying noise is often transmitted by the water pipes throughout the house. In addition, if the shower system 34 (as an example) is already in use when pump 32 turns on, whether the first start or a later cyclic turn-on, the sudden pressure boost in the hot water line 26 from a larger pump can result in an uncomfortable and possibly near-scalding temperature rise in the water at the shower head or other fixture in use. The smaller boost of a "small" pump (i.e., one with a very steep flow-head curve) will result in only a very small and less noticeable increase in shower temperature.

In the preferred embodiment, the single, small pump 32 needs to provide only a flow of approximately 0.3 gpm at 1.0 psi pressure. In accordance with pump affinity laws, such a "small" pump requires a very small impeller or low shaft speed. The inventors have found that use of a very small impeller or low shaft speed also precludes formation of an air bubble in the eye of the impeller, which bubble may be a major cause of noise. Such a small steep curve pump may, however, constitute a significant pressure drop in the hot water line 26 when several fixture taps are opened simultaneously (such as a bathtub and the kitchen sink). To avoid reduced flow in those installations having a relatively low volume pump, a check valve 36 can be plumbed in parallel with pump 32 or incorporated within the pump housing, to pass a flow rate exceeding the pump's capacity around pump 32. When pump 32 is powered and flow demand is low, check valve 36 prevents the boosted flow from re-circulating back to its own inlet. With check valve 36 plumbed around pump 32, it is advantageous to place an orifice 38 in the pump discharge to provide a simple manner to achieve the desired very steep flow-head curve from available stock pump designs. A single pump 32 located at or near water heater 24 in its discharge piping will boost the pressure in the hot water pipes somewhat above that in the cold water pipes (i.e., perhaps one to three feet of boost). With this arrangement only one pump 32 per plumbing system (i.e., per water heater 24) is required with any reasonable number, such as the typical number used in residences, of remote water control valves (i.e., tub/shower valve 10 or service valves 12 and 14), equipped with bypass valves. This is in contrast to those systems that require multiple pumps 32, such as a pump 32 at each fixture where bypassing is desired.

If desired, pump 32 can operate twenty-four hours a day, with most of the time in the no flow mode. However, this is unnecessary and wasteful of electricity. Alternatively, and preferably, pump 32 can have a timer 40 to turn pump 32 on daily at one or more times during the day just before those times when hot water is usually needed the most (for instance for morning showers, evening cooking, etc.) and be set to operate continuously for the period during which hot water is usually desired. This still could be unnecessary and wasteful of electricity. Another alternative is to have the timer 40 cycle pump 32 on and off regularly during the period when hot water is in most demand. The "on" cycles should be of sufficient duration to bring hot water to all remote fixtures that have water control valves (such as valves 10, 12 and 14) equipped with a bypass valve, and the "off" period would be set to approximate the usual time it takes the water in the lines to cool-down to minimum acceptable temperature. Yet another alternative is to equip pump 32 with a normally closed flow switch 42 sized to detect significant flows only (i.e., those flows that are much larger than the bypass flows), such as water flow during use of shower system 34. For safety purposes, the use of such flow switch 42 is basically required if a cyclic timer 40 is used. The switch 42 can be wired in series with the motor in pump 32. If switch 42 indicates an existing flow at the moment timer 40 calls for pump 32 to be activated, open flow switch 42 will prevent the motor from starting, thereby avoiding a sudden increase in water temperature at the fixture (i.e., particularly if it is shower system 34) being utilized. The use of switch 42 accomplishes several useful objectives, including reducing electrical power usage and extending pump 32 life if hot water is already flowing and there is no need for pump 32 to operate, avoiding a sudden temperature rise and the likelihood of scalding that could result from the pump boost if water is being drawn from a "mixing" valve (such as tub/shower valve 10 shown in FIG. 1 or a single handle faucet) and allowing use of a "large" pump 32 (now that the danger of scalding is eliminated) with its desirable low pressure drop at high flows, thereby eliminating the need for the parallel check valve 36 required with a "small" pump 32.

By using a time-of-day control timer 40, pump 32 operates to maintain "instant hot water" only during periods of the day when it is commonly desired. During the off-cycle times, the plumbing system 18 operates just as if the fixture having bypass valve 16 and pump 32 were not in place. This saves electrical power usage from operation of pump 32 and, more importantly, avoids the periodic introduction of hot water into relatively un-insulated pipes during the off-hours, thereby saving the cost of repeatedly reheating this water. The time-of-day control also avoids considerable wear and tear on pump 32 and bypass valve 16. Considerable additional benefits are gained by using a cyclic timer 40, with or without the time-of-day control. In addition to saving more electricity, if a leaky bypass valve 16 (i.e., leaks hot water to cold water line 22) or one not having toggle action is used, there will be no circulating leakage while the pump 32 is cycled off, even if bypass valve 16 fails to shut off completely. Therefore, a simple (i.e., not necessarily leak tight) bypass valve 16 may suffice in less demanding applications. Reducing leakage to intermittent leakage results in reduced warming of the water in cold water line 22 and less reheating of "leaking" re-circulated water.

Figure 2:
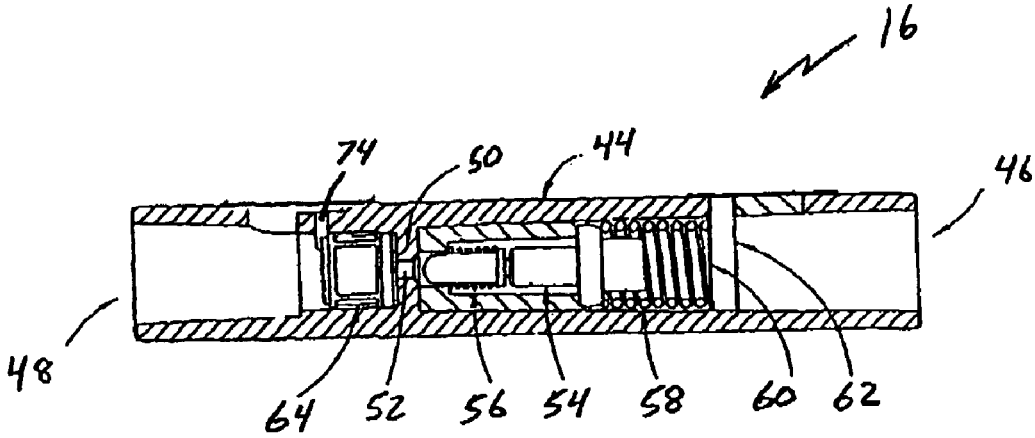
FIG. 2 is a cross-sectional side view of a bypass valve for use with the water control valves of the present invention.

As described above, water control valves 10, 12 and 14 of the present invention can utilize various types of bypass valves 16 to accomplish the objective of bypassing cold or tepid water around the fixture associated with water control valves 10, 12 and 14 which are adaptable for use with bypass valve 16. The preferred bypass valve 16 is the thermostatically controlled type, an example of which is shown in FIG. 2 and described below, due to its ability to automatically sense and respond to the temperature of the water in hot water line 26 at water control valve 10, 12 or 14. Unlike the electrical solenoid type of bypass valve or the manually operated type of bypass valve, a thermostatically controlled bypass valve does not require any external operational input to activate in order to bypass cold or tepid water in hot water line 26 so as to maintain hot water at hot water inlet 30 of water control valves 10, 12 or 14.

Figure 3:
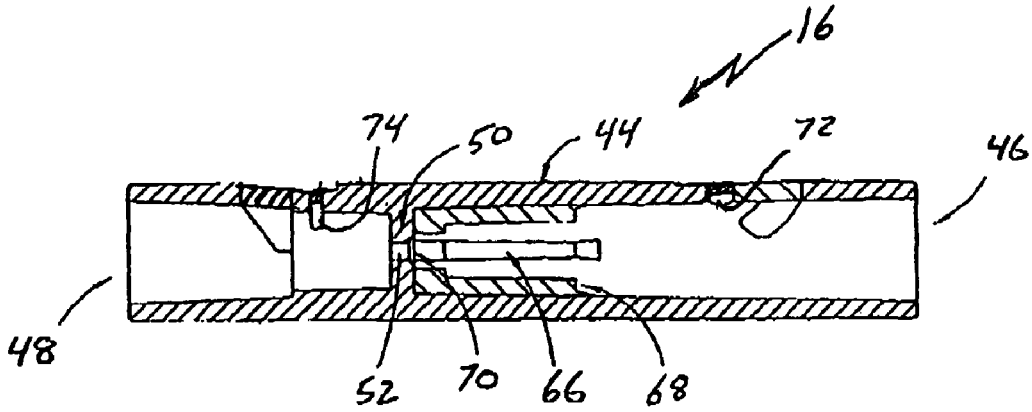
FIG. 3 is a cross-sectional side view of the valve body of the bypass valve shown in FIG. 2.
Figure 4:
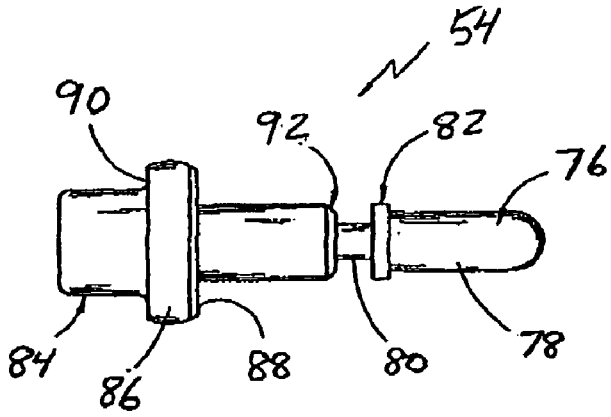
FIG. 4 is a side view of the preferred thermally sensitive actuating element, shown in its unmodified condition, for use in a preferred thermostatically controlled bypass valve of the present invention.

As best shown in FIGS. 2 through 4, the preferred bypass valve 16 is thermostatically controlled bypass valve 16 configured for use with water control valves 10, 12 and 14 of the present invention comprising a generally tubular valve body 44 having bypass valve inlet 46, bypass valve outlet 48 and a separating wall 50 disposed therebetween. As described in more detail below, bypass inlet 46 connects to hot water inlet 30 and bypass outlet 48 connects to cold water inlet 28 of water control valves 10, 12 and 14, either directly or indirectly. Bypass valve passageway 52 in separating wall 50 interconnects inlet 46 and outlet 48 to allow fluid to flow therethrough when bypass valve 16 is bypassing cold or tepid water. As best shown in FIG. 2 and discussed in more detail below, valve body 44 houses a thermally sensitive actuating element 54, bias spring 56, an over-travel spring 58, retaining mechanism 62 (such as a retaining ring, clip, pin or other like device) and check valve 64. Valve body 44 can most economically and effectively be manufactured out of a molded plastic material, such as Ryton.RTM., a polyphenylene sulphide resin available from Phillips Chemical, or a variety of composites. In general, molded plastic materials are preferred due to their relatively high strength and chemical/corrosion resistant characteristics while providing the ability to manufacture the valve body 44 utilizing injection molding processes with the design based on the configuration described herein without the need for expensive casting or machining. Alternatively, valve body 44 can be manufactured from various plastics, reinforced plastics or metals that are suitable for "soft" plumbing loads and resistant to hot chlorinated water under pressure. As shown in FIG. 3, inlet 46 of valve body 44 can be molded with a set of axially oriented fin guides 66 having ends that form an internal shoulder 68 inside valve body 44 for fixedly receiving and positioning one end of thermal actuating element 54 and bias spring 56, and retainer interruption 72 for receiving retaining mechanism 62. Preferably, retaining mechanism 62 is a retaining ring and retainer interruption 72 is configured such that when retaining mechanism 62 is inserted into valve body 44 it will be engagedly received by retainer interruption 72. Bypass valve outlet 48 can be molded with retaining slot 74 for engagement with the snap-in check valve 64. In the preferred embodiment, valve body 44 is designed so the components can fit through inlet 46 and outlet 48, which will typically be one-half inch diameter. In this manner, a one piece bypass valve 16 results with no intermediate or additional joints required for installation.

For ease of installation of the bypass valve 16 by the user, both inlet 46 and outlet 48 on valve body 44 can have one-half inch straight pipe threads for use with the swivel nuts that are commonly found on standard connection hoses that fit the typical residential fixture. The swivel nuts on the connection hoses seal with hose washers against the ends of inlet 46 and outlet 48, as opposed to common pipe fittings that seal at the tapered threads. Inlet 46 and outlet 48 can be marked "hot" and "cold", respectively, to provide visual indicators for the do-it-yourself installer so as to avoid undue confusion. Alternatively, as explained below, bypass valve 16 can be made with integral connections at inlet 46 and outlet 48 for connection to water control valve 10, 12 or 14, thereby avoiding the need for extra connections.

An example of a thermally sensitive actuating element 54 for use with the preferred thermostatically controlled bypass valve 16 is shown in FIG. 4. Actuating element 54 is preferably of the wax filled cartridge type, also referred to as wax motors, having an integral poppet rod member 76 comprising poppet 78 attached to piston 80 with an intermediate flange 82 thereon. The end of poppet 78 is configured to seat directly against valve seat 70 or move a shuttle (i.e., spool or sleeve valves) so as to close passage 52. These thermostatic control actuating elements 54 are well known in the art and are commercially available from several suppliers, such as Caltherm of Bloomfield Hills, Mich. The body 84 of actuating element 54 has a section 86 of increased diameter, having a first side 88 and second side 90, to seat against shoulder 68 or like element in valve body 44. Piston 80 of rod member 76 interconnects poppet 78 with actuator body 84. Actuating element 54 operates in a conventional and well known manner. Briefly, actuating element 54 comprises a blend of waxes or a mixture of wax(es) and metal powder (such as copper powder) enclosed in actuator body 84 by means of a membrane made of elastomer or the like. Upon heating the wax or wax with copper powder mixture expands, thereby pushing piston 80 and poppet 78 of rod member 76 in an outward direction. Upon cooling, the wax or wax/copper powder mixture contracts and rod member 76 is pushed inward by bias spring 56 until flange 82 contacts actuator body 54 at actuator seat 92. Although other types of thermal actuators, such as bi-metallic springs and memory alloys (i.e., Nitinol and the like) can be utilized in the present invention, the wax filled cartridge type is preferred because the wax can be formulated to change from the solid to the liquid state at a particular desired temperature. The rate of expansion with respect to temperature at this change of state is many times higher, resulting in almost snap action of the wax actuating element 54. The temperature set point is equal to the preset value, such as 97 degrees Fahrenheit, desired for the hot water. This is a "sudden" large physical motion over a small temperature change. As stated above, this movement is reacted by bias spring 56 that returns rod member 76 as the temperature falls.

Because bypass valve 16 has little or no independent "toggle action," after a few cycles of opening and closing, bypass valve 16 tends to reach an equilibrium with the plumbing system, whereby bypass valve 16 stays slightly cracked open, passing just enough hot water to maintain the temperature constantly at its setting. In particular plumbing systems and at certain ambient conditions, this flow is just under that required to maintain a spring loaded check valve cracked continuously open (i.e., check valve 36). In such a situation, check valve 36 chatters with an annoying buzzing sound. To avoid this occurrence, the spring may be removed from check valve 36, leaving the check valve poppet free floating. In the event that the hot water is turned full on at a time when bypass valve 16 is open, thereby lowering the pressure in hot water line 26 and inducing flow from cold water line 22 through the open bypass valve 16 to the hot side, the free floating poppet will quickly close. There is no necessity for a spring to keep check valve 36 closed prior to the reversal in pressures.

Although not entirely demonstrated in early tests, it is believed that beneficial "toggle" action can be achieved with the thermostatically controlled bypass valve 16 discussed above. If the motion of actuating element 54 is made to lag behind the temperature change of the water surrounding it by placing suitable insulation around actuating element 54 or by partially isolating it from the water, then instead of slowly closing only to reach equilibrium at a low flow without reaching shutoff, the water temperature will rise above the extending temperature of the insulated actuating element 54 as bypass valve 16 approaches shutoff, and piston 80 will then continue to extend as the internal temperature of actuating element 54 catches up to its higher surrounding temperature, closing bypass valve 16 completely. It is also believed that an insulated actuating element 54 will be slow opening, its motion lagging behind the temperature of the surrounding cooling-off water from which it is insulated. When actuating element 54 finally begins to open the bypass valve 16 and allow flow, the resulting rising temperature of the surrounding water will again, due to the insulation, not immediately affect it, allowing bypass valve 16 to stay open longer for a complete cycle of temperature rise. Such an "insulated" effect may also be accomplished by use of a wax mix that is inherently slower, such as one with less powdered copper or other thermally conductive filler. An actuating element 54 to be installed with insulation can be manufactured with a somewhat lower set point temperature to make up for the lag, allowing whatever bypass valve 16 closing temperature desired.

An additional benefit of utilizing pump 32 in system 18 is that shut-off of a toggle action valve upon attainment of the desired temperature is enhanced by the differential pressure an operating pump 32 provides. If pump 32 continues to run as the water at water control valve 10, 12 or 14 cools down, the pump-produced differential pressure works against reopening a poppet type bypass valve 16. If pump 32 operates cyclically, powered only a little longer than necessary to get hot water to water control valve 10, 12 or 13, it will be "off" before the water at bypass valve 16 cools down. When the minimum temperature is reached, actuating element 54 will retract, allowing bias spring 56 to open bypass valve 16 without having to fight a pump-produced differential pressure. Bypass flow will begin with the next pump "on" cycle. An additional benefit to the use of either a time-of-day or cyclic timer 40 is that it improves the operating life of actuating element 54. Because use of either timer 40 causes cyclic temperature changes in bypass valve 16 (as opposed to maintaining an equilibrium setting wherein temperature is constant and actuating element 54 barely moves), there is frequent, substantial motion of the piston 80 in actuating element 54. This exercising of actuating element 54 tends to prevent the build-up of hard water deposits and corrosion on the cylindrical surface of actuator piston 80 and face of poppet 78, which deposits could render bypass valve 16 inoperable.

Also inside bypass valve 16 can be an over-travel spring 58 disposed between the second side 90 of the actuator body 84 and a stop, such as retaining mechanism 62 shown in FIG. 2, located inside bypass valve 16 to prevent damage to a fully restrained actuating element 54 if it were heated above the maximum operating temperature of bypass valve 16 and to hold actuating element 54 in place during operation without concern for normal tolerance. Use of over-travel spring 58, which is not necessary for spool-type valves, allows movement of actuator body 84 away from the seated poppet 78 in the event that temperature rises substantially after poppet 78 contacts valve seat 70. Without this relief, the expanding wax could distort its copper can, destroying the calibrated set point. Over-travel spring 58 also holds bias spring 56, rod member 76 and actuator body 84 in place without the need to adjust for the stack-up of axial tolerances. Alternatively, actuating element 54 can be fixedly placed inside bypass valve 16 by various mechanisms known in the art, including adhesives and the like. Over-travel spring 58, if used, can be held in place by various internal configurations commonly known in the art, such as a molded seat (not shown).

Although there are a great many configurations and brands of water control valves 10, 12 and 14, it is believed that there are several generic forms of such valves that can be used to illustrate the present invention. The water control valves adaptable for use with bypass valves 16, including but not limited to thermostatically controlled bypass valves, include a combination shower/tub valve 10, a separate service control valve 12 and a combination service control valve 14. As such, these generic forms of water control valves 10, 12 and 14 are utilized below to illustrate several different designs that are adaptable for the use of bypass valve 16 therewith. The following examples are only representative of the types of water control valves which bypass valve 16 can be used. As is well known in the art, the individual manufacturers have various models of water control valves to incorporate desired features and preferences. The examples are for illustrative purposes only and are not intended to restrict the invention to particular uses, sizes or materials used in the examples.

EXAMPLE 1

Shower/Tub Control Valve with Attached Bypass Valve

As is well known, many homes have a combination shower and tub assembly whereby the same water control valve 10 is used to control the flow and temperature to the shower and the tub. A selector valve (not shown) is used to select the flow between the shower and the tub. An example shower/tub system is shown as 34 in FIG. 1. A similar water control valve to that shown as 10, is used for systems comprising only a shower or a tub, with the exception that such valve only has one discharge port (connected to either the shower or the tub). In the shower/tub system 34, water distribution valve 10 with associated bypass valve assembly 98, having bypass valve 16 as described below, distributes water to the shower head assembly 100 through shower line 102 and to tub faucet 104 through tub line 106, as shown in FIG. 1. A flow control valve 108 is used to control the flow and temperature of water to the shower head assembly 100 or tub faucet 104. Although a single flow control valve 108 is shown in FIG. 1, it is understood that some shower, tub and shower/tub flow control valves utilize separate valves for the hot and cold water control (i.e., similar in general configuration to the service control valves discussed below). One of the primary distinguishing characteristics of virtually all shower/tub water control valves, such as 10, and single shower or tub water control valves is that they are generally positioned at least partially behind support wall 110 that forms part of the shower and/or tub enclosure and which is used to support shower head assembly 100 and tub faucet 104. Because access to water control valve 10 is important for maintenance, repair or replacement of water control valve 10, even if positioned entirely behind support wall 110, water control valve 10 is generally placed behind an opening 112 in support wall 110 specifically configured for accessing water control valve 10. Typically a removable plate 114, commonly referred to as an escutcheon plate, is used to cover opening 112. To access water control valve 10 and bypass valve assembly 98, plate 114 is removed and valve 10 is maintained, repaired or removed through opening 112 in support wall 110 and then plate 114 is reinstalled.

Figure 5:
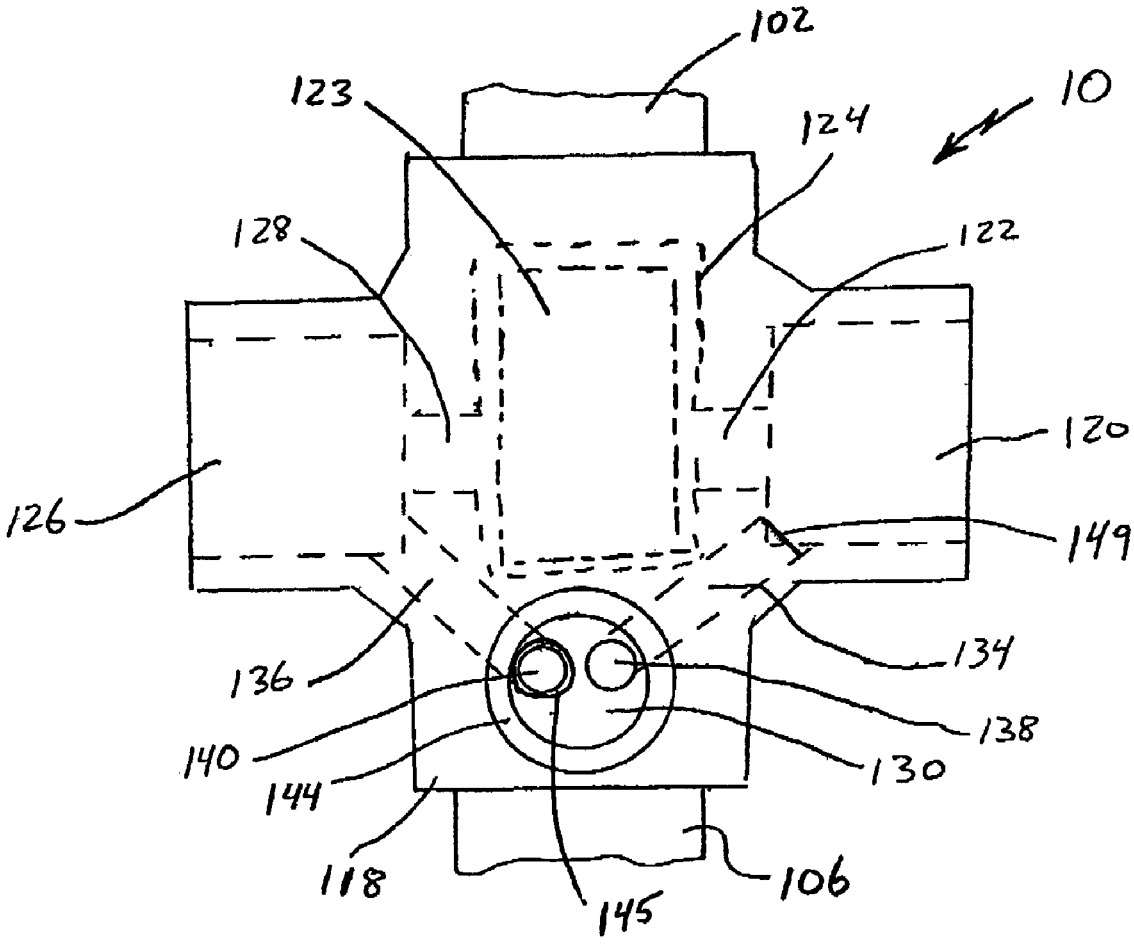
FIG. 5 is a front view of a shower/tub water control valve of the present invention without the bypass valve mounted thereon as seen through the opening in the support wall for a shower system.
Figure 6:
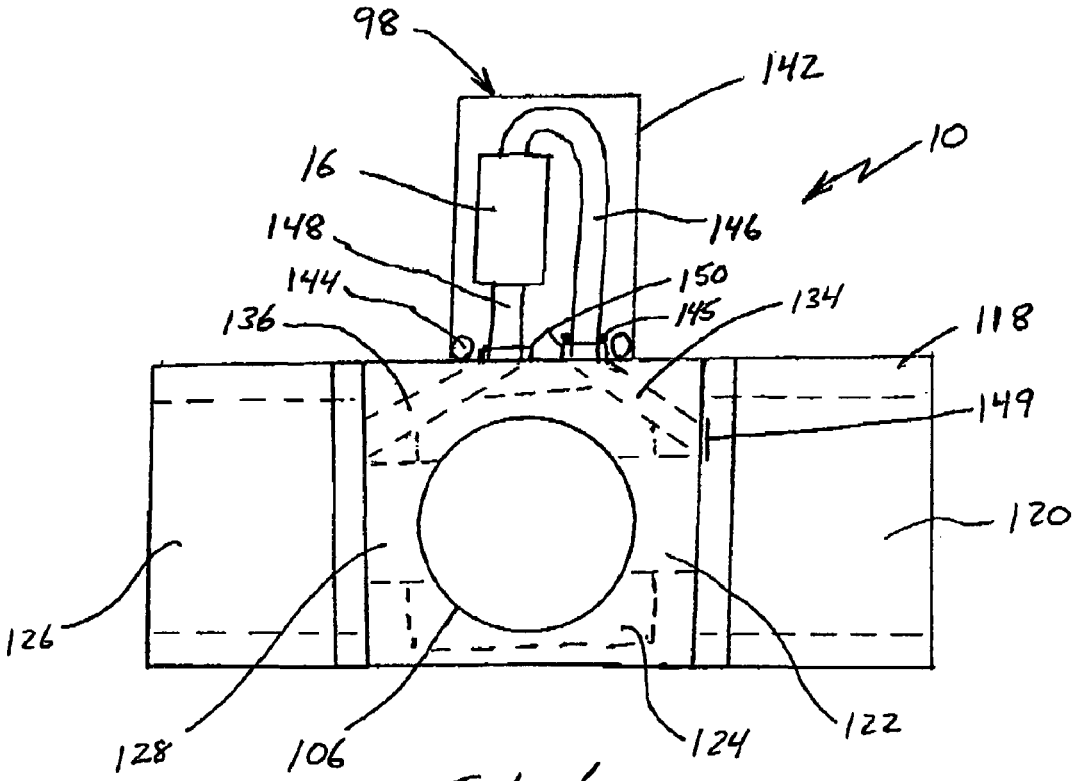
FIG. 6 is a side view of the water control valve of FIG. 5 showing the interior components of a bypass valve mounted thereon.

Shower/tub water control valve 10, shown in more detail in FIGS. 5 and 6, is used to illustrate various configurations for providing valve 10 that is adaptable for use with bypass valve 16. The typical water control valve 10 consists of a valve manifold 118 having a hot water inlet 120 that connects to hot water line 26 to allow hot water to flow through control valve hot passageway 122 to the inner valve workings, which generally comprise a removable valve cartridge 123, inside cartridge cavity or valve interface 124 of valve manifold 118. The typical valve interface 124 is configured as a cylindrical cavity sized to frictionally receive valve cartridge 123 therein and to have ports for the inflow of hot and cold water and the discharge of mixed water to shower line 102 and/or tub line 106. Cold water inlet 126 of valve 10 connects to cold water line 22 to allow cold water to flow through control valve cold passageway 128 to valve cartridge 123 inside valve interface 124. Inside valve interface 124, valve cartridge 123 selectively distributes hot and cold water to shower head assembly 100 or tub faucet 104 through shower line 102 or tub line 106, respectively. For the present invention, water control valve 10 is modified to be adaptable for use with bypass valve 16 by adding a single external port 130 on valve manifold 118, an internal hot water bypass passageway 134, an internal cold water bypass passageway 136 and separate hot water bypass port 138 and cold water bypass port 140. In the preferred embodiment, water control valve 10 of the present invention has valve manifold 118 manufactured to include external port 130, internal bypass passageways 134 and 136 and bypass ports 138 and 140. Although an existing water control valve 10 can be modified to include these components, it is believed to be much easier and cost effective to include them in the initial manufacturing process than to add them to an existing valve 10. Although the bypass valve assembly 98 is shown affixed to the top of water control valve 10 in FIG. 1 and in front of water control valve 10 in FIG. 6, bypass valve assembly 98 can be affixed to water control valve 10 at any place on valve manifold 118 which is convenient, practical or cost effective. An important aspect of attachment of bypass valve assembly 98 for use with water control valve 10 of the present invention is the ability to access bypass valve assembly 98 through opening 112 in support wall 110 for purposes of maintenance, repair or replacement of bypass valve 16.

In the preferred embodiment of water control valve 10 having external port 130, as shown in FIGS. 5 and 6, bypass valve assembly 98 comprises a bypass housing 142 enclosing bypass valve 16 and water control valve 10 has a sealing element, such as O-ring 144, to seal the connection between bypass housing 142 and valve manifold 118 at external port 130. To prevent cross-flow between bypass ports 138 and 140, and therefore bypassing of bypass valve 16, at least one of these ports should have a sealing member, such as an O-ring or other sealing member (not shown). Bypass valve input line 146 connects hot water bypass passageway 134 with bypass valve inlet 46 and bypass valve output line 148 connects bypass valve outlet 48 to cold water bypass passageway 136. Connecting elements 150 of the type known by those in the industry, such as clips, unions, bolts, threaded connections and the like, are used to connect bypass valve input line 146 with hot water bypass passageway 134 and bypass valve output line 148 with cold water bypass passageway 136. Also in the preferred embodiment, control valve 10 includes screen 149 positioned at or near the entrance to hot water bypass passageway 134. Screen 149 should be installed in a manner that allows it to be self-cleaning. As is known in the art, this can be accomplished by placing screen 149 in water control valve 10 such that the main flow of hot water from hot water inlet 120 will flow across the face of screen 149 when "hot" water is flowing through water control valve 10 to discharge through shower line 102 or tub line 106. When water is being bypassed, screen 149 will filter out any debris that could otherwise plug or damage bypass valve 16. The materials collected on screen 149 will then be washed away through water control valve 10 when hot water flows through water control valve 10 to shower line 102 or tub line 106 (i.e., the discharge from water control valve 10).

When installed with water control valve 10, as shown in FIG. 6, bypass valve assembly 98 is sealably and rigidly connected to and supported by valve manifold 118 in shower system 34. When the water in hot water line 26 is no longer at the desired temperature (i.e., the temperature lowers to be tepid or cool), bypass valve 16 opens to bypass the non-hot water around water control valve 10 by diverting water flow from hot water line 26 through hot water bypass passageway 134 and hot water bypass port 138 into bypass valve input line 146 through bypass valve 16 to bypass output line 148, cold water bypass port 140, cold water bypass passageway 136 and then to cold water line 22. In the preferred embodiment, pump 32 provides the pressure in hot water line 26 for the necessary bypassing. The bypassing of this cool or cold water in hot water line 26 will continue until the temperature in hot water line 26 is at the desired temperature. At that time, bypass valve 16 will close and hot water (as desired) will be at the water control valve 10 ready for selection by flow control valve 108 and distribution to shower head assembly 100 or tub faucet 104.

As discussed above, bypass valve 16 inside of bypass valve assembly 98 can be of the thermostatically controlled, electric solenoid, manually operated or other type of bypass valve. The preferred embodiment utilizes a thermostatically controlled bypass valve, such as that described above with the wax motor as the thermal actuating element 54, due to its ability to automatically bypass cold or tepid water until the temperature of the water in hot water line 26 at control valve 10 is at the desired temperature. Water control valve 10 can be provided with bypass assembly 98 already connected to valve manifold 118 or water control valve 10 can be sold as an optional unit having a removable cap element (not shown) closing external port 130 to seal against sealing element 144 and sealing member 145 for when bypass assembly 98 is not in use with water control valve 10. In yet another configuration, bypass assembly 98 is fixedly attached to or manufactured with valve manifold 118 such that water control valve 10 and bypass assembly 98 are a single unit. This configuration would eliminate the need for sealing element 144 and sealing member 145, such as the O-rings shown in FIGS. 5 and 6. While the embodiment of the single bypass assembly 98 and water control valve 10 as a single unit has the advantage of eliminating a seal and, as a result, a potential leak source, utilizing bypass assembly 98 as a separate unit has the advantage of allowing the same water control valve 10 to be sold with or without bypass valve 16 and allowing the user to maintain, repair or replace bypass valve 16 separate from water control valve 10. As stated above, whether the bypass assembly 98 is sold integral with water control valve 10 or as single unit requiring sealing element 144, it should be configured to be accessible to the user through opening 112 in support wall 110.

Figure 7:
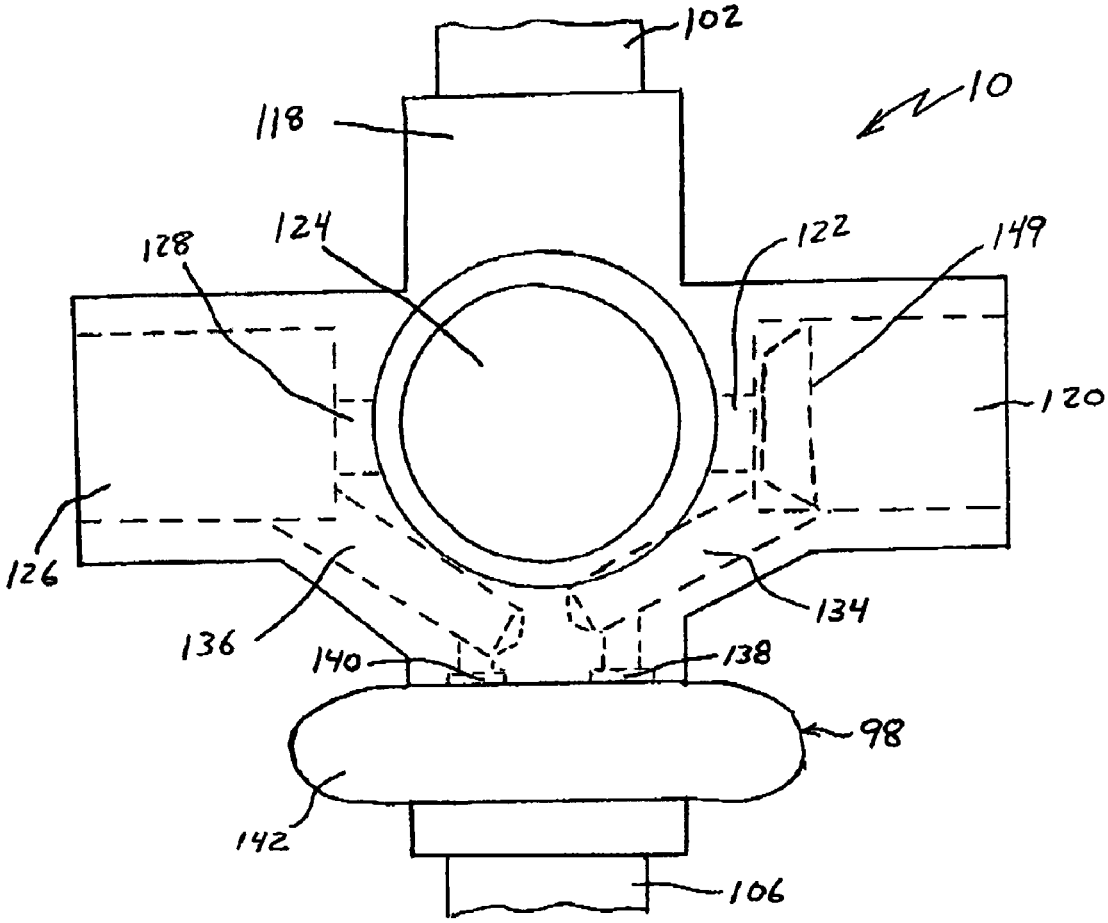
FIG. 7 is a front view of a shower/tub water control valve of the present invention having a bypass valve assembly mounted thereon.
Figure 8:
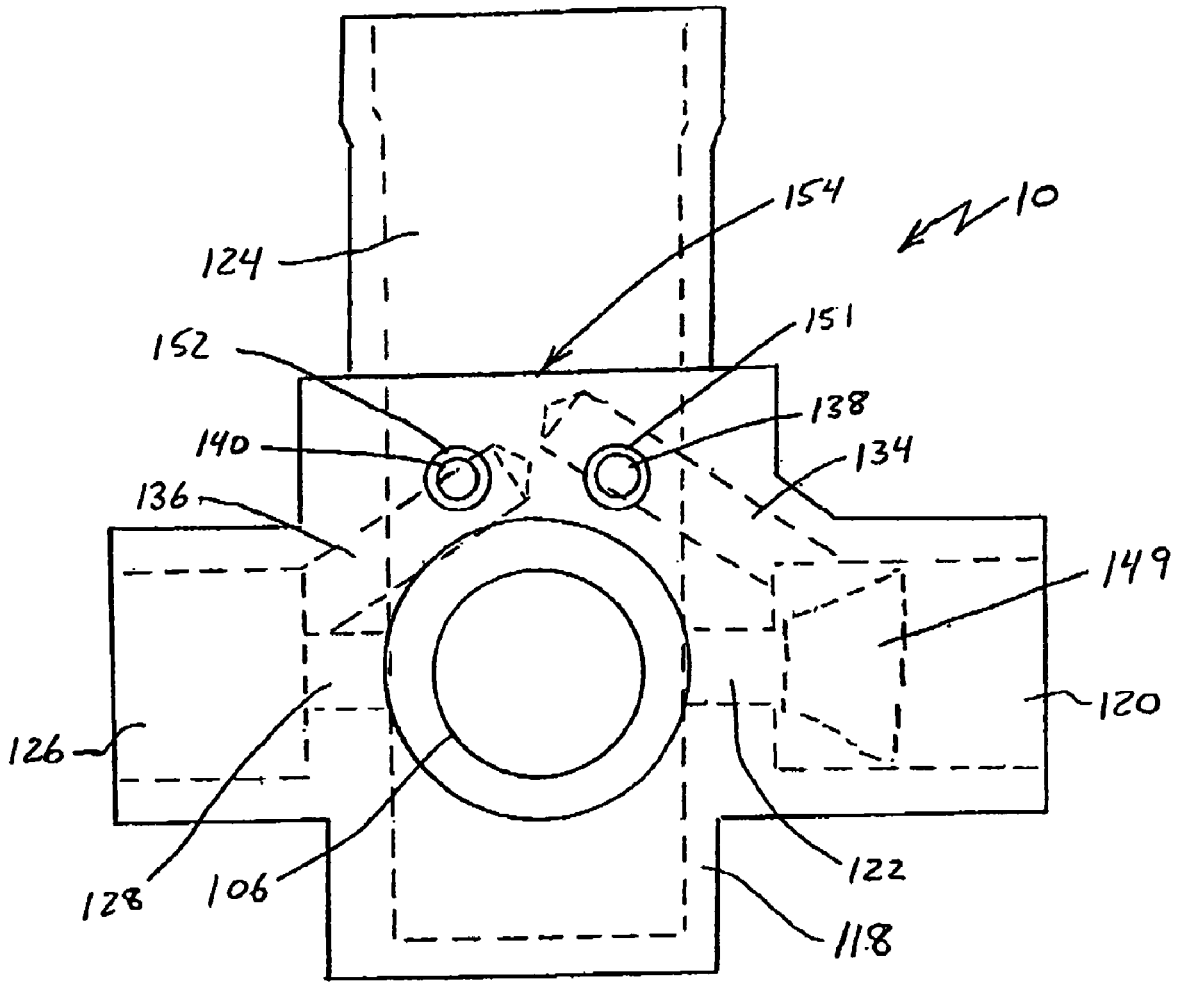
FIG. 8 is a side view of the shower/tub water control valve of FIG. 7 without the bypass assembly mounted thereon showing the hot and cold water bypass ports for connection to the bypass valve.
Figure 9:
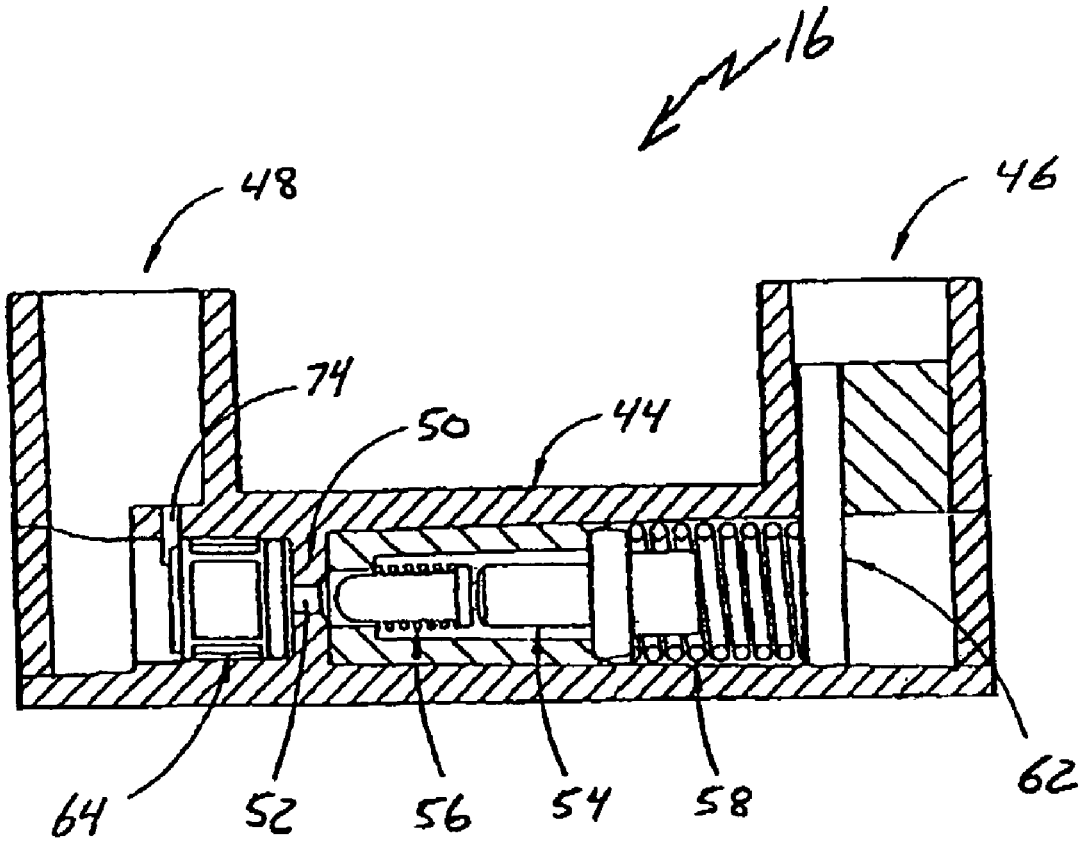
FIG. 9 is a cross-sectional side view of a modified bypass valve for use with the water control valves of the present invention.

Another configuration for a water control valve 10 having a rigidly attached bypass valve 16 is shown in FIGS. 7 and 8 and an alternative bypass valve 16 particularly configured for use with such a water control valve 10 is shown in FIG. 9. In this configuration, instead of the single external port 130 utilizing one atmospheric sealing element 144, the hot 138 and cold 140 water bypass ports connect directly to the respective input 146 and output 148 lines of bypass valve 16 with atmospheric seals at each such connection. As with the above water control valve 10, valve manifold 118 of this configuration is also manufactured to have or modified to have hot water bypass passageway 134 interconnecting hot water inlet 120 and hot water bypass port 138 and cold water bypass passageway 136 interconnecting cold water inlet 126 and cold water bypass port 140. As shown in FIG. 7, bypass assembly 98, configured generally as shown in FIG. 6, connects to directly to the hot 138 and cold 140 water input ports with the bypass valve 16 disposed inside bypass housing 142 to bypass water around water control valve 10. As shown in FIG. 8, hot water bypass port 138 has sealing element, such as O-ring 151, to sealably connect port 138 with the input line 146 to bypass valve 16 and cold water bypass port 140 has sealing element, such as O-ring 152, to sealably connect port 140 with the output line 148 from bypass valve 16. As also shown in FIG. 8, valve manifold 118 can include enlarged portion 154 for mounting bypass assembly 98 or bypass valve 16 against valve manifold 118. As shown in FIG. 7 and explained above, screen 149 can be placed at or near the entrance to hot water bypass passageway to filter debris and be self-cleaning.

As with the previous embodiment of water control valve 10, bypass valve 16 can be of the thermostatically controlled, electric solenoid, manually operated or other type of bypass valve. Instead of utilizing bypass assembly 98, as shown in FIG. 7, valve body 44 of bypass valve 16 can be modified to mount directly to hot 138 and cold 140 bypass ports. One embodiment of such a bypass valve 16 is shown in FIG. 9. This embodiment comprises a generally U-shaped bypass valve body 44 with valve inlet 46 and valve outlet 48 configured to sealably mount to hot water bypass port 138 and cold water bypass port 140, respectively. This embodiment, which utilizes the thermostatically controlled components discussed in detail above, requires bypass valve inlet 46 and bypass valve outlet 48 to be spaced in corresponding relationship to hot water bypass port 138 and cold water bypass port 140.

When installed, bypass valve assembly 98 or bypass valve 16 is sealably and rigidly connected to and supported by valve manifold 118 in shower system 34. When the water in hot water line 26 is no longer at the desired temperature (i.e., the temperature lowers to be tepid or cool), bypass valve 16 opens to bypass the non-hot water around water control valve 10 by diverting water flow from hot water line 26 at hot water inlet 120 through hot water bypass passageway 134 and hot water bypass port 138 into bypass valve inlet 46 then through bypass valve 16 to bypass valve output 48, cold water bypass port 140, cold water bypass passageway 136 and then to cold water line 22 at cold water inlet 126. In the preferred embodiment, pump 32 provides the pressure in hot water line 26 for the necessary bypassing. The bypassing of this cool or cold water in hot water line 26 will continue until the temperature in hot water line 26 is at the desired temperature. At that time, bypass valve 16 will close and hot water (as desired) will be at the water control valve 10 ready for selection by flow control valve 108 and distribution to shower head assembly 100 or tub faucet 104.

As with the previous embodiment, water control valve 10 can be provided with bypass assembly 98 or bypass valve 16 already connected to valve manifold 118 or water control valve 10 can be sold with removable cap elements (not shown) that sealably close hot 138 and cold 140 bypass ports so that bypass assembly 98 or bypass valve 16 can be provided as an optional unit. In yet another alternative configuration, bypass assembly 98 or bypass valve 16 is fixedly attached to or manufactured with valve manifold 118 such that water control valve 10 and bypass assembly 98 or bypass valve 16 are a single, integral unit. This configuration eliminates the need for sealing elements 150 and 152. As stated above, whether the bypass assembly 98 or bypass valve 16 is sold integral with water control valve 10 or as separate units requiring sealing elements 150 and 152, it should be configured to be accessible to the user through opening 112 in support wall 110.

Figure 10:
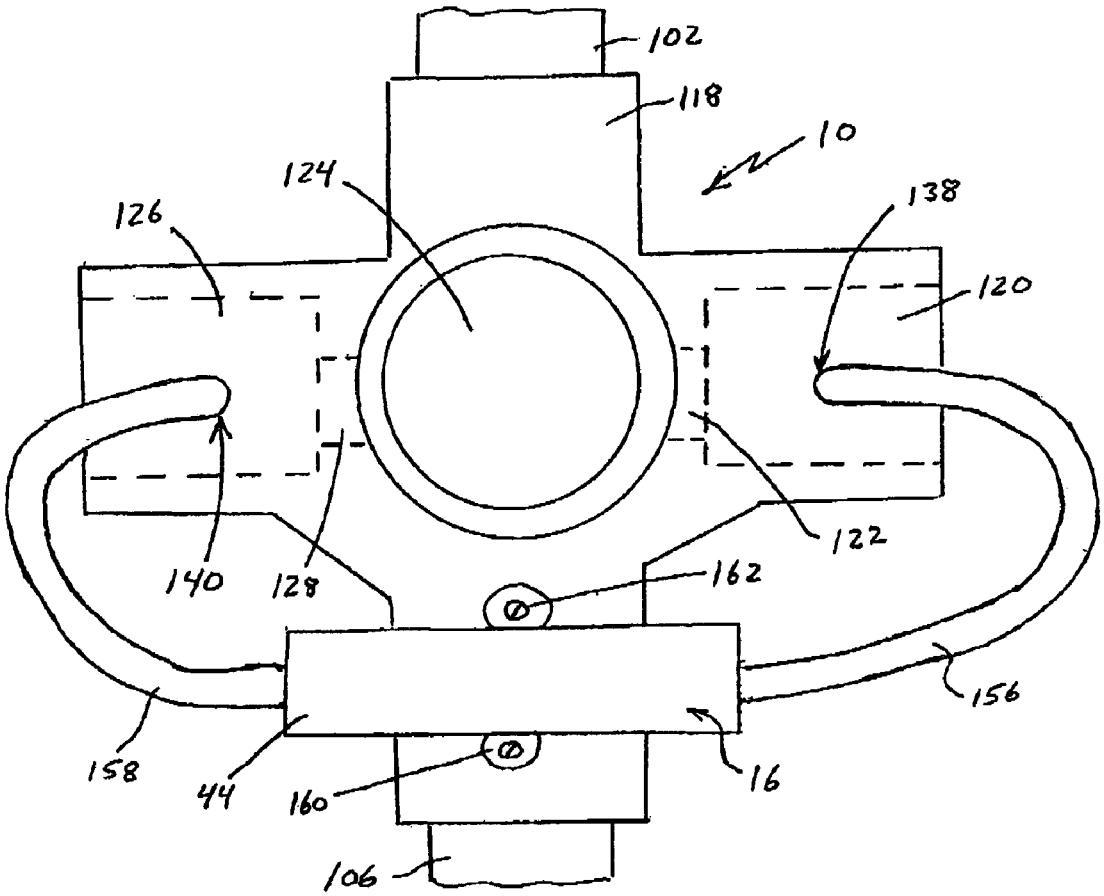
FIG. 10 is a front view of a shower/tub water control valve having a bypass valve attached to the water control valve and tubular lines interconnecting the bypass ports on the water control valve and the bypass valve.

Another embodiment of a water control valve 10 having an attached bypass valve 16 is shown in FIG. 10. In this embodiment, bypass valve inlet 46 is connected to hot water bypass port 138 by first tubular line 156 and bypass valve outlet 48 is connected to cold water bypass port 140 by second tubular line 158. As shown in FIG. 10, hot 138 and cold 140 bypass ports can connect to hot water inlet 120 and cold water inlet 126, respectively, through bypass passageways 134 and 136 (shown in other figures) that extend through the wall of valve manifold 118 at hot 120 and cold 126 water inlets. Alternatively, hot 138 and cold 140 bypass ports can be positioned at other places on valve manifold 118, such as shown in FIGS. 7 and 8, with hot 134 and cold 136 bypass passageways interconnecting bypass ports 138 and 140 with inlets 120 and 126. In the preferred embodiment, first 156 and second 158 tubular lines are flexible tubular members such as the flexible hose commonly utilized in plumbing facilities. Alternatively, first 156 and second 158 tubular lines can be semi-rigid or rigid tubing, such as that made out of copper, stainless steel, fiberglass or various composite materials. As known by those skilled in the art, connections between hot water bypass port 138 and first tubular line 156 and between first tubular line 156 and bypass valve inlet 46, as well as those on the cold water side of control valve 10, should be sealed to prevent leakage of water.

In the attached configuration of this embodiment, bypass valve 16 is affixed to valve manifold 118 by one or more connecting elements 160 each having one or more attachment mechanisms 162, such as a screw, bolt, rivet or etc. Connecting elements 160 can be an integral part of bypass valve body 44, as shown in FIG. 10, or they can be separate elements used to attach one piece onto another piece, such as a U-shaped strap. In this manner, bypass valve 16 is affixed to water control valve 10 and accessible with it through opening 112 in support wall 110. As above, although the preferred bypass valve 16 is the thermostatically controlled bypass valve previously described, bypass valve 16 can be the needle valve, electric solenoid or manually operated type of bypass valves. In addition, bypass valve 16 can be sold integral with tubular lines 156 and 158 or the control valve 10 and bypass valve 16 can be sold as a single integral unit to eliminate the necessary sealing elements between the various connections. In addition, as previously described, control valve 10 can be sold with one or more cap elements (not shown) to seal ports 138 and 140 so that bypass valve 16 and associated tubular lines 156 and 158 can be sold separately.

When installed, bypass valve 16 is sealably and rigidly connected to and supported by valve manifold 118 in shower system 34 by use of connecting element 160 and attachment mechanisms 162. When the water in hot water line 26 is no longer at the desired temperature (i.e., the temperature lowers to be tepid or cool), bypass valve 16 opens to bypass the non-hot water around water control valve 10 by diverting water flow from hot water line 26 at hot water inlet 120 through hot water bypass passageway 134, hot water bypass port 138 and first tubular line 156 into bypass valve inlet 46 through bypass valve 16 to bypass valve output 48, second tubular line 158, cold water bypass port 140, cold water bypass passageway 136 and then to cold water line 22 at cold water inlet 126. In the preferred embodiment, pump 32 provides the pressure in hot water line 26 for the necessary bypassing. The bypassing of this cool or cold water in hot water line 26 will continue until the temperature in hot water line 26 is at the desired temperature. At that time, bypass valve 16 will close and hot water (as desired) will be at the water control valve 10 ready for selection by flow control valve 108 and distribution to shower head assembly 100 or tub faucet 104.

Figure 11:
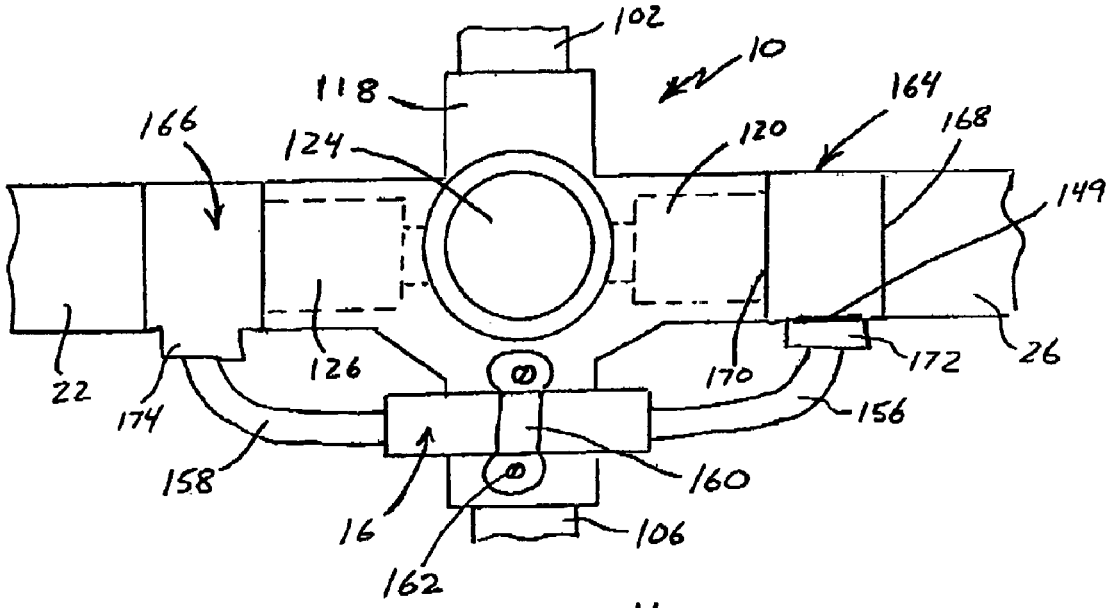
FIG. 11 is a front view of a shower/tub water control valve connected to a pair of bypass connectors that connect to a bypass valve attached to the water control valve.

Yet another embodiment of a water control valve 10 having an attached bypass valve 16 is shown in FIG. 11. In this embodiment, a standard water control valve 10 is utilized with a first bypass connector 164 and second bypass connector 166 that connect to bypass valve 16. As shown in FIG. 11, bypass connector 164 is disposed between hot water line 26 and hot water inlet 120 and bypass connector 166 is disposed between cold water line 22 and cold water inlet 126. Bypass connectors 164 and 166 can be of the standard tee (as shown) or three-way elbow type of connector having an inlet 168 and control valve outlet 170 to connect to control valve 10. Bypass connector 164 has bypass outlet 172 and bypass connector 166 has bypass inlet 174, configured as shown in FIG. 11, to connect to bypass valve 16. As with the previous embodiment, the connection between first bypass connector 164 and hot water inlet 120 and between second bypass connector 166 and cold water inlet 126 can be by flexible or rigid tubular lines 156 and 158, respectively. The connections between first 164 and second 166 bypass connectors and control valve 10 and bypass valve 16 should be by sealable connectors so as to prevent leakage at such connections. As discussed in more detail above, bypass connectors 164 and 166, tubular lines 156 and 158 and bypass valve 16 can be provided as a single, integral unit and bypass connectors 164 and 166 can be provided with cap elements (not shown) to close off bypass outlet 172 when bypass valve 16 is not used or removed from service through opening 112 in support wall 110 for maintenance, repair or replacement. As also discussed above, water control valve 10 can be provided with screen 149 to filter debris before it gets to bypass valve 16. Placing screen 149 at or near the entrance to bypass outlet 172, as shown, will allow screen 149 to be self-cleaning by washing the face of screen 149 when hot water is flowing through water control valve 10. As with the embodiment shown in FIG. 10, bypass valve 16 is affixed to valve manifold 118 so that it is supported from valve manifold 118. FIG. 11 shows the use of a U-shaped strap as the connecting element 160 held in place against valve manifold 118 by a pair of attachment mechanisms 162. With the water control valve 10 in the closed position, any cold or tepid water in hot water line 26 will be diverted around water control valve 10 through first bypass connector 164 and first tubular line 156 to bypass valve 16 and then to second tubular line 158 and second bypass connector 166 to cold water line 22. As soon as the water being bypassed reaches the desired temperature, bypass valve 16 will close so that hot water, at the desired temperature, will be at control valve 10 for use at shower head assembly 100 or tub faucet 104.

EXAMPLE 2

Shower/Tub Control Valve with Adjacent Bypass Valve

Figure 12:
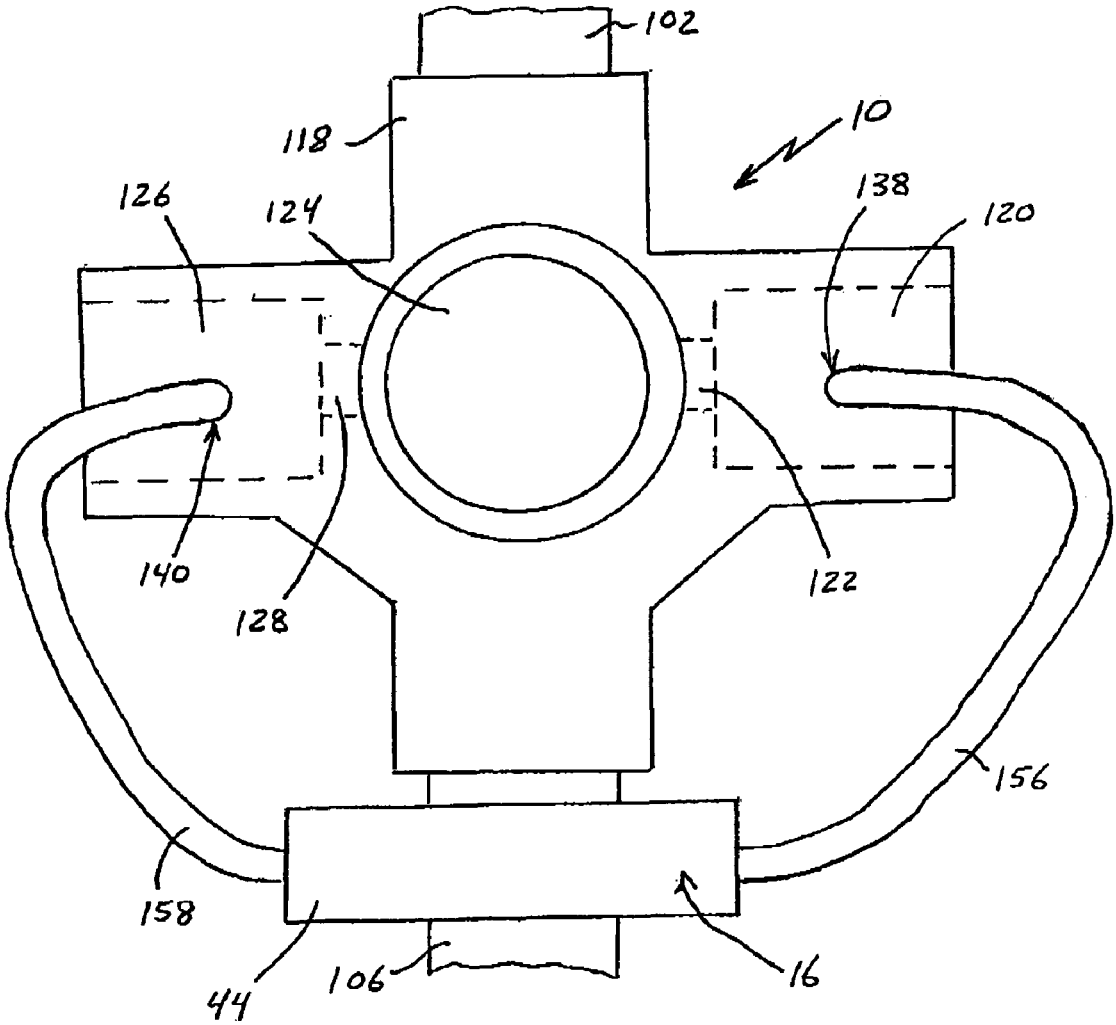
FIG. 12 is a front view of a shower/tub water control valve having a bypass valve adjacent to the water control valve and connected to bypass ports on the water control valve.
Figure 13:
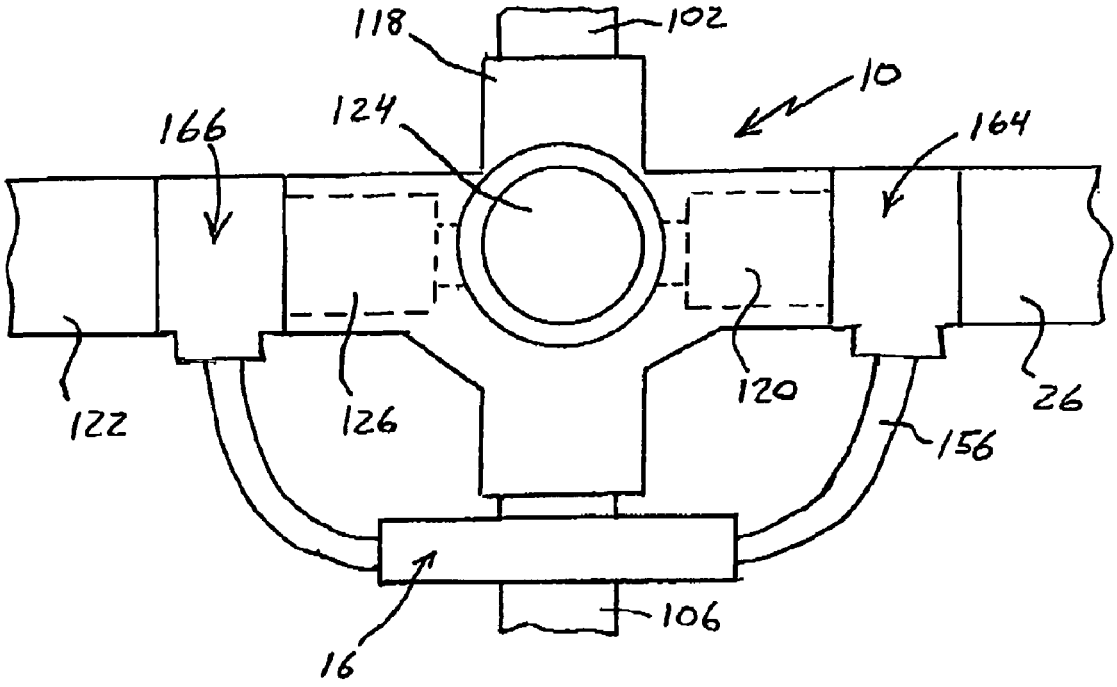
FIG. 13 is a front view of a shower/tub water control valve connected to a pair of bypass connectors that connect to a bypass valve positioned adjacent to the water control valve.

In the embodiment of the present invention where bypass valve 16 is adjacent to (i.e., but not physically attached to or supported by) water control valve 10, shown in FIGS. 12 and 13, bypass valve 16 is directly supported by first tubular line 156 and second tubular line 158. FIG. 12 illustrates a configuration similar to that shown in FIG. 10 and discussed above except for there is no connecting element 160 or attachment mechanism 162 to affix bypass valve 16 to valve manifold 118. Likewise, FIG. 13 illustrates a configuration similar to that shown in FIG. 11 and discussed above except there is no connecting element 160 or attachment mechanism 162 for affixing bypass valve 16 to valve manifold 118. Depending on the flexibility of first tubular line 156 and second tubular line 158, bypass valve 16 hangs freely from their connection to ports 138 and 140 on water control valve 10 or from first 164 and second 166 bypass connectors. The principal benefit of the adjacent configuration is that there is no need for connecting element 160 and any mechanism to attach it to valve manifold 118 and it may be easier to retrofit existing water control valve 10 installations by the necessary components. This is particularly true with regard to the embodiment shown in FIG. 13 that only requires the addition of first 164 and second 166 bypass connectors between an existing water control valve 10 and the existing hot water line 26 and cold water line 22. As discussed above, these embodiments can also include self-cleaning screen 149. Instead of utilizing water control valve 16, the various embodiments of the present invention set forth herein, including those discussed above, can utilize bypass valve assembly 98 having bypass valve 16 disposed therein.

Figure 14:
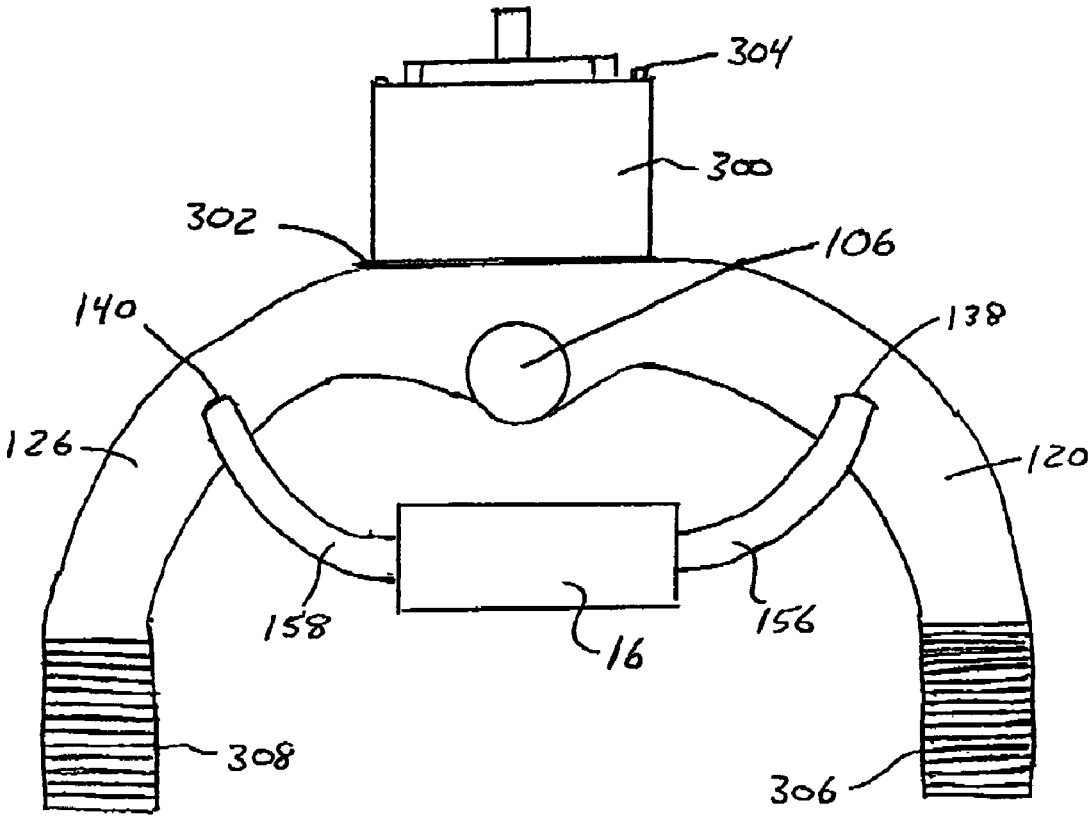
FIG. 14 is a front view of a tub water control valve having a alternative configuration for the valve manifold with the bypass valve adjacent to the water control valve and connected to bypass ports on the water control valve.

In the embodiment of water control valve 10 shown in FIG. 14, valve manifold 118 is configured to have an external valve cartridge 300 that is attached to valve manifold 118 at manifold interface 302. The primary difference between the embodiment shown in FIG. 14 and those previously described is that valve interface 124 is configured in the form of a generally cylindrical cavity adaptable for receiving valve cartridge 123 therein. Instead of utilizing valve cartridge 123 of the previous embodiments, which interfaces with the cylindrical cartridge cavity (i.e., valve interface 124) inside of valve manifold 118, the embodiment of FIG. 14 utilizes valve cartridge 300 that removably abuts flat interface 302, which is configured to have ports for the flow of hot and cold water to valve cartridge 300 and the discharge of mixed water to shower line 102 and/or tub line 106. Generally, valve cartridge 300 attaches to valve interface 302 by way of one or more attachment mechanisms, such as screws 304. With regard to the use of bypass valve 16, the embodiment shown in FIG. 14 is similar in concept to that shown in FIG. 13 and described above. Typically, valve manifold 118 of this configuration has hot water threaded end 306 and cold water threaded end 308 for connection to the supply of hot water and cold water, respectively. As with the previous embodiment, first tubular line 156 interconnects hot water bypass port 138 on hot water inlet 120 to bypass valve inlet 46 on bypass valve 16 and second tubular line 158 interconnects bypass valve outlet 48 to cold water bypass port 140 on cold water inlet 126. As discussed above, appropriate sealing members need to be utilized to prevent leakage and self-cleaning screen 149 can be used to prevent debris and other matter from entering bypass valve 16. Although the embodiment shown in FIG. 14 is similar to that of FIG. 13, it is known and understood that the embodiments shown in FIGS. 5 through 8 and 10 through 12 can also be adapted for use with the valve manifold 118 and cartridge 300 combination of FIG. 14.

EXAMPLE 3

Service Control Valve

In the embodiment wherein bypass valve 16 is included with the water control valve, shown as water control valves 12 and 14 in FIGS. 14 through 17, bypass valve 16 is integrated with or appended to a pair of individual water control valves 12, also known as angle stops, or incorporated with a combination water control valve 14. These types of valves are commonly referred to as service valves or non-working valves because they are not operated so as to be frequently moved from the opened to closed positions. Service valves are primarily utilized to connect to washing machines, sinks or faucets on sinks, dishwashing machines and the like apparatuses. Normally, service valves are left in the open position, only being closed to repair or replace the apparatus. In the open position, water is allowed to flow freely to the apparatus, with the apparatus itself having a control valve such as an electrically controlled solenoid valve incorporated therein to control the amount of cold or hot water allowed into the apparatus. Unfortunately, no provision is generally made for the fact that hot water may not actually be at the service valve, due to the cooling effect discussed above, when the apparatus's control valve opens to allow in "hot" water to the apparatus. As such, undesirably cold or tepid water may be utilized in the apparatus to clean clothes or dishes or perform other operations best done in hot water.

Figure 15:
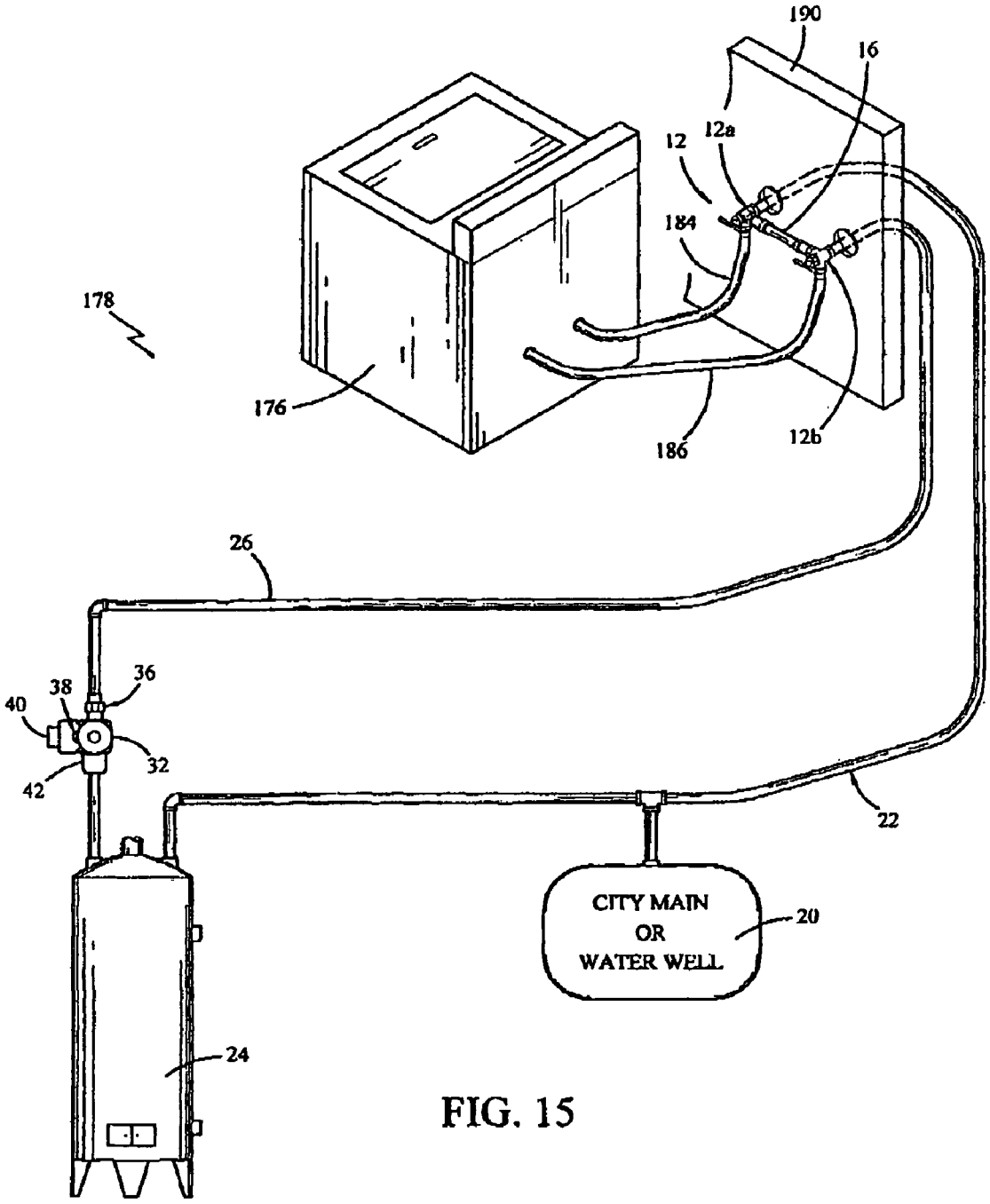
FIG. 15 is a water distribution system utilizing a water control valve of the present invention as a service valve for a water utilizing apparatus.
Figure 16:
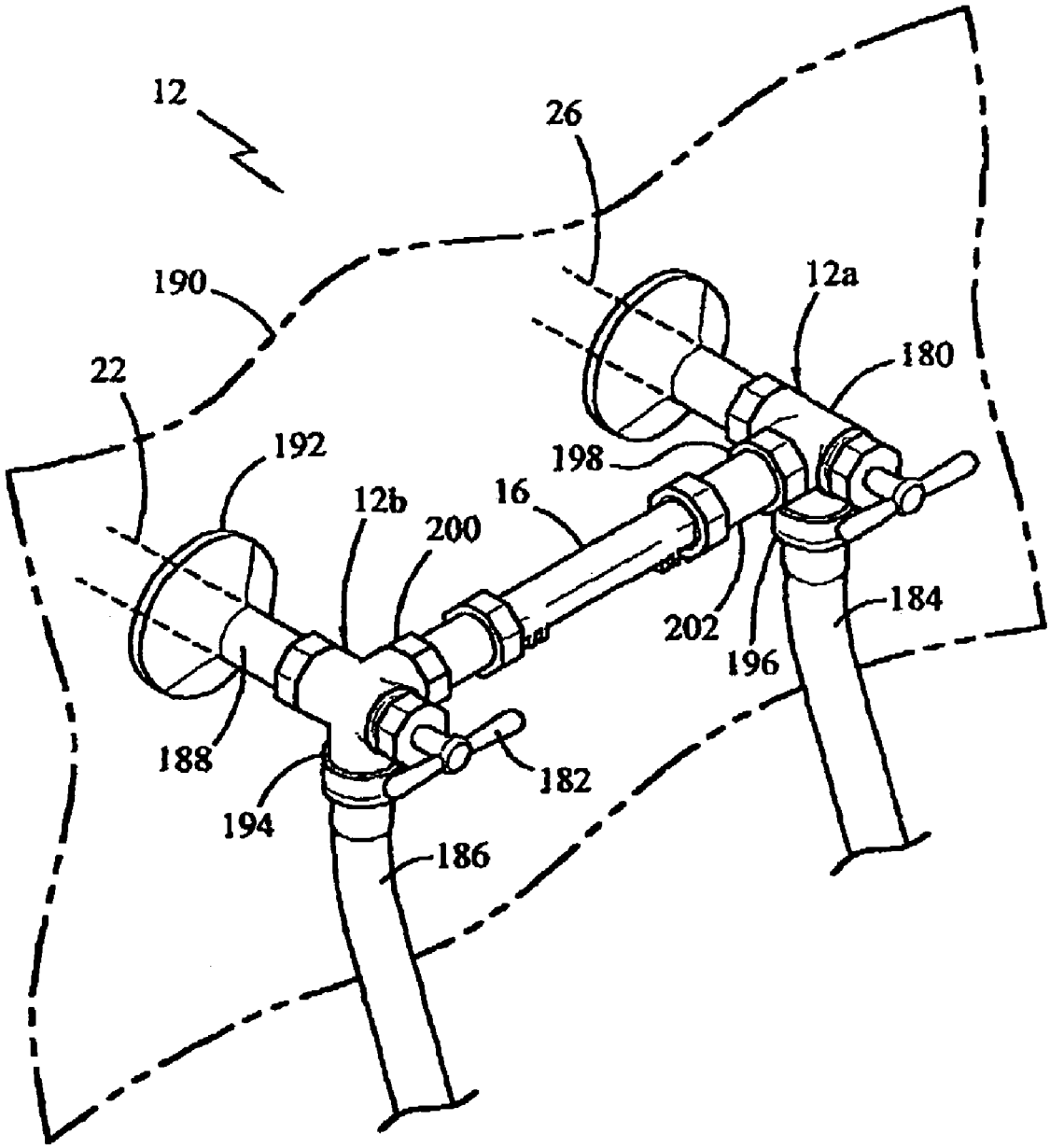
FIG. 16 is a perspective view of a pair of water control valves of the present invention modified for use with an interconnecting bypass valve.

As shown in FIGS. 15 and 16, in use water control valve 12 comprises a pair of independent water control valves, hot water valve 12*a* and cold water 12*b* to supply hot or cold water to the apparatus 176 (shown as a washing machine in FIG. 15 illustrating a system 178 utilizing water control valve 12). Generally, other than the water that flows through them, water control valves 12*a* and 12*b* are the same and, when referenced herein collectively as water control valve 12, is meant to refer to both hot water valve 12*a* and cold water valve 12*b*. Water control valve 12 has valve manifold 180 enclosing the inner workings (not shown) of water control valve 12 that are operated by an operating mechanism, such as handle 182, to open or close valve 12 to independently allow water, hot or cold depending on which water valve 12*a* or 12*b* is operated, to flow to apparatus 176 through hot water hose 184 or cold water hose 186, respectively. Generally, water control valve 12 has an inlet 188 with a connection suitable to connect to an end of either hot water line 26 or cold water line 22, depending on which valve 12*a* or 12*b* is referenced, extending through wall 190 and past cover plate 192. Water control valve 12 also has a first valve outlet 194, generally configured with a male connection suitable for connecting to female coupling 196 on the end of hose 184 or 186.

Each of water control valves 12*a* and 12*b* of the present invention are modified to include a hot water second outlet 198 and cold water second outlet 200, respectively, to connect to bypass valve 16 for bypassing cold or tepid water around valves 12*a* and 12*b* so as to maintain hot water at water control valve 12*a* ready for use by apparatus 176. Although the preferred bypass valve 16 is a thermostatically controlled bypass valve, as described above, bypass valve 16 can be the needle, electric solenoid, manually operated or other type of bypass valve. As also discussed above, screen 149 can be utilized to screen debris before it gets to bypass valve 16 and be positioned at or near the entrance to hot water second outlet 198 to be self-cleaning when hot water is not flowing to apparatus 176. Depending on the distance between water valves 12*a* and 12*b*, one or more tubular extension members 202 will be necessary to connect hot water second outlet 198 to bypass valve inlet 46 and/or to connect bypass outlet 48 to cold water second outlet 200. Alternatively, bypass valve 16 can have valve inlet 46 and valve outlet 48 which extend to interconnect water control valves 12*a* and 12*b* to eliminate the additional connections necessary for extension members 202, although this could limit flexibility with regard to the distance between valves 12*a* and 12*b*. Use of one or more extension members 202, such as the two shown in FIG. 16, provide increased flexibility with regard to the spacing of valves 12*a* and 12*b*. In yet another alternative, water control valves 12*a* and 12*b* could be manufactured integral with bypass valve 16, thereby completely eliminating the need for separate tubular extension members 202 and any connections to second valve outlets 198 and 200. When installed, bypass valve 16 is sealably and rigidly connected and supported adjacent to water control valves 12*a* and 12*b* in system 178. When the water in hot water line 26 is no longer at the desired temperature (i.e., the temperature lowers to be tepid or cool), bypass valve 16 opens to bypass the non-hot water around water control valves 12*a* by diverting water flow from hot water line 26 at hot water second outlet 198 through extension member 202, if used, into bypass valve inlet 46 then through bypass valve 16 to bypass valve output 48 and then to cold water line 22 at cold water second outlet 200. In the preferred embodiment, pump 32 provides the pressure in hot water line 26 for the necessary bypassing. The bypassing of this cool or cold water in hot water line 26 will continue until the temperature in hot water line 26 is at the desired temperature. At that time, bypass valve 16 will close and hot water (as desired) will be at the water control valve 12*b* ready for selection by the flow control valve at or inside apparatus 176.

Figure 17:
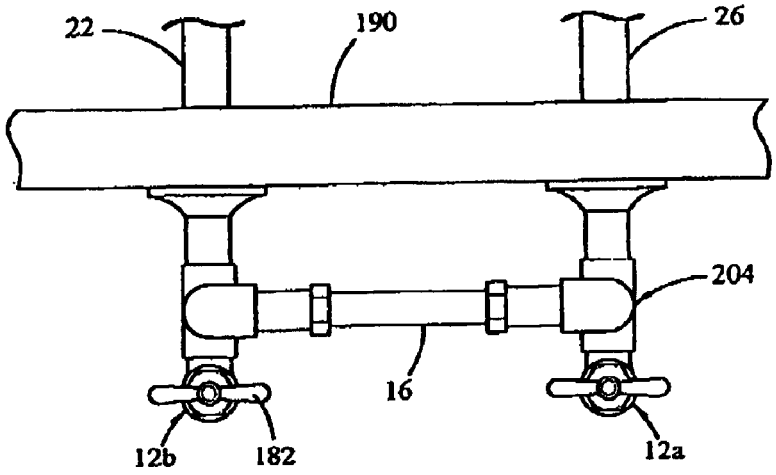
FIG. 17 is a top view of a pair of water control valves of the present invention utilizing a pair of saddle valves to interconnect with a bypass valve.
Figure 18:
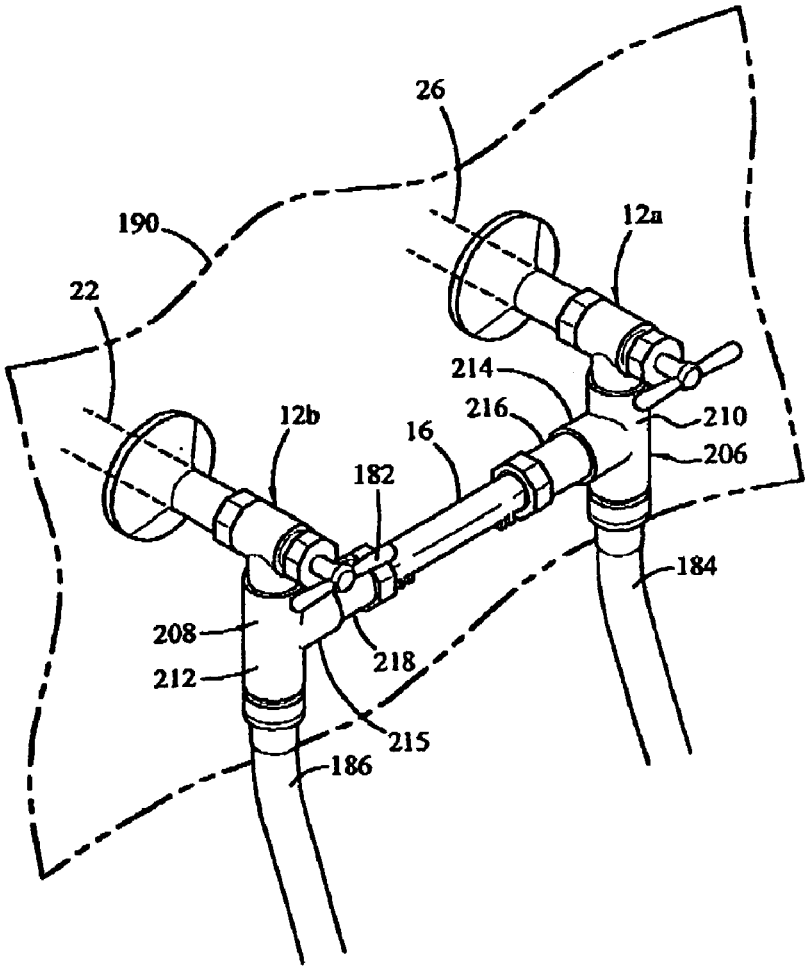
FIG. 18 is a perspective view of a pair of water control valves of the present invention utilizing a pair of bypass connectors to interconnect with a bypass valve.

As an alternative, system 178 can be modified to utilize a pair of saddle valves 204, such self tapping variety, to establish a connection between water control valves 12*a* and 12*b* for connection to bypass valve 16, as shown in FIG. 17. Saddle valves 204 can be located in front of wall 190, as shown, for ease of access for repair, maintenance or replacement of bypass valve 16 or they can be located behind wall 190. Alternatively, not shown, saddle valves 204 can attach to and interconnect hot water hose 184 and cold water hose 186 to bypass cold or tepid water through bypass valve 16. In yet another configuration, shown in FIG. 18, system 178 can utilize a first bypass connector 206 connected to water control valve 12*a* and second bypass connector 208 connected to water control valve 12*b* that connect to bypass valve 16. As shown, bypass connector 206 is disposed between outlet 194 on valve 12*a* and hose coupling 196 on hot water hose 184, and bypass connector 208 is disposed between outlet 194 on valve 12*b* and hose coupling 196 on cold water hose 186 to bypass cold or tepid water from hot water line 26 to cold water line 22. Bypass connectors 206 and 208 can be of the standard tee type (as shown) or three-way elbow type of connector having an inlet 210 and hose outlet 212 to connect to control valves 12*a* and 12*b* and hoses 184 and 186. Bypass connector 206 has bypass outlet 214 and bypass connector 208 has bypass inlet 215, configured as shown in FIG. 18, to connect to bypass valve 16. The connection between first bypass connector 206 and bypass valve inlet 46 on bypass valve 16 and between second bypass connector 208 and bypass valve outlet 48 can be by flexible or rigid tubular lines 216 and 218, respectively. The connections between first 206 and second 208 bypass connectors and control valves 12*a* and 12*b* and bypass valve 16 should be by sealable connectors so as to prevent leakage at such connections. As discussed in more detail above, bypass connectors 206 and 208, tubular lines 216 and 218 and bypass valve 16 can be provided as a single, integral unit and bypass connectors 206 and 208 can be provided with cap elements (not shown) to close off bypass outlets 214 when bypass valve 16 is not used or removed from service for maintenance, repair or replacement.

Figure 19:
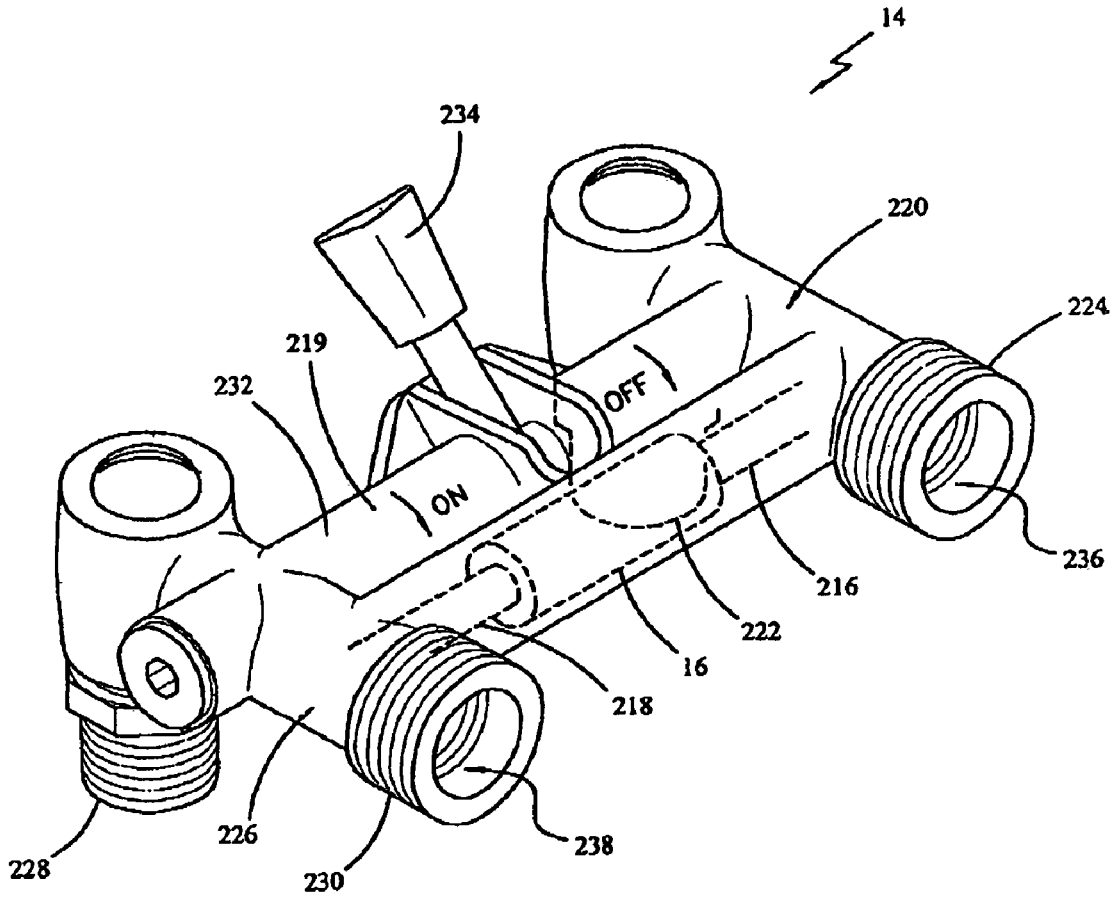
FIG. 19 is perspective view of a combination water control valve of the present invention utilizing a bypass valve therein to interconnect the hot and cold components of the water control valve.

Another embodiment of a water control valve 14 with an included bypass valve 16 is shown in FIG. 19. In this embodiment, the hot and cold water service valves are joined together in a single unit having a valve manifold 219 with a hot water component 220 having a hot water inlet 222 and hot water outlet 224 and a cold water component 226 having a cold water inlet 228 and cold water outlet 230. Hot water component 220 and cold water component 226 of water control valve 14 are joined by a tubular section 232 enclosing the inner workings (not shown) of control valve 14 that are operated by an operating mechanism, such as lever 234 (could be a handle, dial, switch or other like mechanisms). When lever 234 is moved to the "on" position, the inner workings of valve 14, which can be of the ball valve type, operate to open the connection between hot water inlet 222 and hot water outlet 224 to allow hot water to flow through hot water chamber 236 to apparatus 176 through a hose or other tubular member (such as hose 184 with a female coupling 196 thereon) connected to hot water outlet 224. Concurrently therewith, the connection between cold water inlet 228 and cold water outlet 230 opens to allow cold water to flow through cold water chamber 238 to apparatus 176 through a hose or other tubular member connected to cold water outlet 230. When lever 234 is moved to the "off" position, valve 14 closes to prevent hot and cold water from flowing to apparatus 176. For water control valve 14 of the present invention adaptable for use to bypass cold or tepid water, bypass valve 16 is incorporated within tubular section 232 such that tubular line 216 interconnects hot water chamber 236 with bypass valve inlet 46 and tubular line 218 interconnects bypass valve outlet 48 with cold water chamber 238. Screen 149 can be placed at or near the entrance to tubular section 232 to filter debris from the bypassed water and be self-cleaning when water is not being bypassed. As above, the preferred bypass valve 16 is a thermostatically controlled bypass valve, such as the thermostatically controlled bypass valve described above, bypass valve 16 can be the needle, electric solenoid or manually operated type of bypass valve. With bypass valve 16 installed and water control valve 14 in the "on" or open position, any cold or tepid water in hot water line 26 at hot water component 220 will be bypassed through tubular section 232 to cold water component 226 and to cold water line 22 so as to maintain hot water available at hot water component 220.

Figure 20:
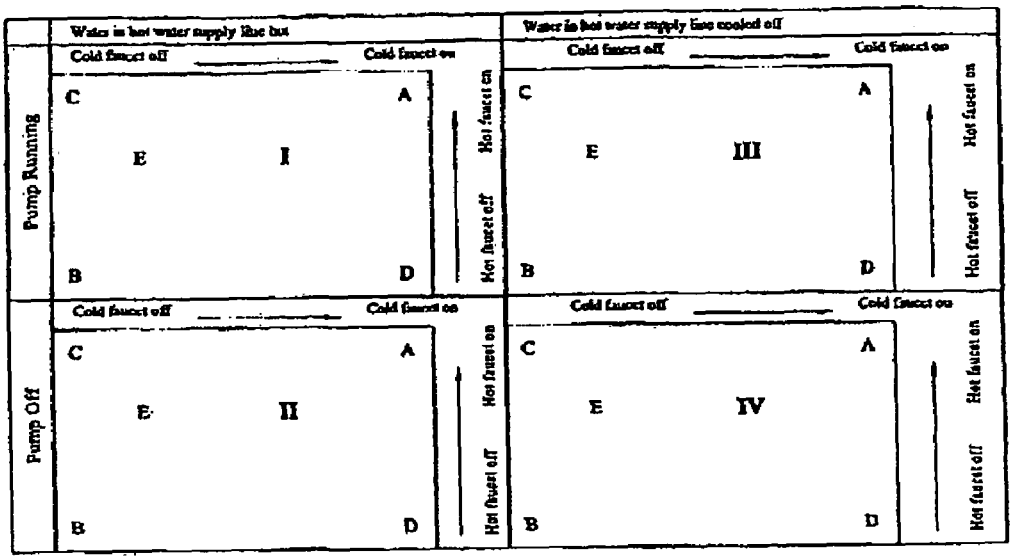
FIG. 20 is chart showing the operational characteristics of the preferred thermostatically controlled bypass valve of the present invention when in use with a water distribution system.

With regard to the use of a thermostatically controlled bypass valve 16 having the components shown in FIGS. 2 through 4 and described in the accompanying text, the operation of the bypass valve 16 of the present invention is summarized on the chart shown as FIG. 20. The chart of FIG. 20 summarizes the results of the twenty combinations of conditions (pump on/pump off; hot water line hot/hot water line cooled off; hot water valve fully open, closed or between; cold water valve fully open, closed or between) that are applicable to the operation of bypass valve 16. The operating modes IVB, IVC, IVD, IIIB, & IIID are summarized detailed in the immediately following text. The operation of the remaining fifteen modes are relatively more obvious, and may be understood from the abbreviated indications in the outline summarizing FIG. 20. Starting with the set "off" hours (normal sleeping time, and daytime when no one is usually at home) pump 32 will not be powered. Everything will be just as if there were no pump 32 and no bypass valve 16 in use with water control valves 10, 12 or 14 (i.e., both the cold and hot water lines will be at the same city water pressure). The water in hot water line 26 and at bypass valve 16 will have cooled off during the long interim since the last use of hot water. The reduced water temperature at bypass valve 16 results in "retraction" of rod member 76 of the thermally sensitive actuating element 54. The force of bias spring 56 pushing against flange 82 on rod member 76 will push it back away from valve seat 68, opening bypass valve 16 for recirculation. Although the thermal actuating element 54 is open, with pump 32 not running, no circulation flow results, as the hot 26 and cold 22 water lines are at the same pressure. This is the mode indicated as IVB in the outline on FIG. 20. If the cold water valve at water control valve 10, 12 or 14 is opened with thermal actuating element 54 open as in mode IVB above, pressure in cold water line 22 to the cold water side of water control valve 10, 12 or 14 will drop below the pressure in hot water line 26. This differential pressure will siphon tepid water away from the hot side to the cold side, which is the mode indicated as IVD in the outline on FIG. 20. The recirculation of the "hot" water will end when the tepid water is exhausted from the hot water line 26 and the rising temperature of the incoming "hot" water causes actuating element 54 to close.

If the hot water side of water control valve 10, 12 or 14 is turned on with actuating element 54 open as in mode IVB above, pressure in hot water line 26 will drop below the pressure in cold water line 22. This differential pressure, higher on the cold side, will load check valve 64 in the "closed" direction allowing no cross flow. This is mode IVC in the outline on FIG. 20. In this mode, with hot water line 26 cooled and pump 32 off, a good deal of cooled-off water will have to be run just as if bypass valve 16 were not installed), to get hot water, at which time actuating element 54 will close without effect, and without notice by the user. With actuating element 54 open and hot water line 26 cooled-off as in mode IVB above, at the preset time of day (or when the cyclic timer trips the next "on" cycle) pump 32 turns on, pressurizing the water in hot water line 26. Pump pressure on the hot side of water control valves 10, 12 or 14 results in flow through the open actuating element 54, thereby pressurizing and deflecting check valve 64 poppet away from its seat to an open position. Cooled-off water at the boosted pressure will thus circulate from the hot line 26 through actuating element 54 and check valve 64 to the lower pressure cold water line 22 and back to water heater 24. This is the primary "working mode" of the bypass valve 16 and is the mode indicated as IIIb in the outline on FIG. 20. If the cold water valve is turned on during the conditions indicated in mode IIIB above (i.e., pump 32 operating, hot water line 26 cooled off, and the hot water valve at water control valve 10, 12 or 14 turned off) and while the desired recirculation is occurring, mode IIID will occur. A pressure drop in the cold water line 22 due to cold water flow creates a pressure differential across valve 16 in addition to the differential created by pump 32. This allows tepid water to more rapidly bypass to cold water line 22. When the tepid water is exhausted from hot water line 26, actuating element 54 will close, ending recirculation.

Explanation of FIG. 20 Table

MODE I: Water In Hot Water Supply Line Hot, Pump On.

A. Hot and cold water valves fully open Pressure drops from hot and cold flow about equal. Actuating element 54 stays closed. No leak or recirculation in either direction.

B. Hot and cold water valves full closed Actuating element 54 keeps bypass valve 16 closed. No recirculation.

C. Hot water valve fully open, cold water valve closed Actuating element 54 closed. Check valve 64 closed. No recirculation. No leak.

D. Hot water valve closed, cold water valve fully open Actuating element 54 closed. No recirculation. No leak.

E. Hot and cold water valves both partially open in any combination Actuating element 54 closed. No recirculation. No leak.

MODE II: Water in Hot Water Supply Line Hot, Pump Off.

A. Hot and Cold water valves full on Pressure drops from hot and cold flow about equal. Actuating element 54 stays closed.

B. Hot and cold water valves fully closed Actuating element 54 keeps bypass valve 16 closed. No recirculation.

C. Hot water valve fully open, cold water valve closed Actuating element 54 closed. Check valve 64 closed. No recirculation. No leak.

D. Hot water valve closed, cold water valve fully open Actuating element 54 closed. No recirculation. No leak.

E. Hot and cold water valves both partially open in any combination. Actuating element 54 closed. No recirculation. No leak.

MODE III: Water in Hot Water Line Cooled Off, Pump On.

A. Hot and cold water valves full open

Flow-induced pressure drops about equal, bypass valve 16 stays open and allows recirculation hot to cold until tepid water is exhausted and hotter water closes actuating element 54. If both sides of water control valve are discharging to the same outlet they are mixing hot and cold anyway. If the valves being manipulated are at remote fixture on the same plumbing branch, this short time tepid-to-cold leak will probably not be noticeable. If valves being manipulated are on remote branches of plumbing, the mixing would have no effect.

B. Hot and cold water valves fully closed Actuating element 54 open, get desired tepid-to-cold recirculation until hot water line 26 heats up.

C. Hot water valve fully open, cold water valve closed. Actuating element 54 open but pressure drop in hot water line 26 may negate pump pressure, stopping recirculation. Check valve 64 stops cold to hot leak.

D. Hot water valve closed, cold water valve fully open Actuating element 54 open, get tepid to cold recirculation until hot line heats up. E. Hot and cold water control valves both partially open in any combination Could get tepid to cold leak. If valves are at same fixture don't care as mixing hot and cold anyway. If at remote fixture probably not noticeable. Tepid to cold leak would be short term.

MODE IV: Water In Hot Water Supply Line Cooled Off, Pump Off.

A. Hot and cold water valves full open Flow-induced pressure drops about equal, bypass valve 16 stays open and may allow recirculation (leak) hot to cold until tepid water is exhausted and hotter water closes actuating element 54. Don't care, if both valves are at same fixture as are mixing hot and cold anyway. If water control valves being manipulated are at remote fixtures on the same plumbing branch, this short time tepid-to-cold leak would probably not be noticeable. If water control valves being manipulated are on remote branches of plumbing, mixing would not be noticeable.

B. Hot and cold water valves fully closed Actuating element 54 open, no recirculation.

C. Hot water valve fully open, cold water valve fully closed Actuating element 54 open. Check valve 64 closed. No leak D. Hot water valve closed. Cold water valve fully open Bypass valve 16 open, tepid to cold recirculation until actuating element 54 heats up and closes.

E. Hot and cold water valves both partially open, in any combination. Could get tepid to cold leak. If water control valves at same fixture, don't care as mixing hot and cold anyway. If at remote fixture probably not noticeable. Tepid to cold leak would be short term.

Figure 21:
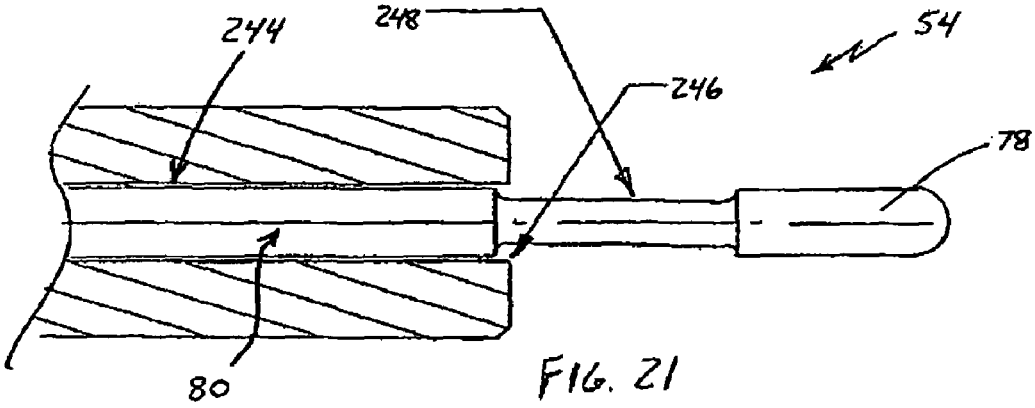
FIG. 21 is a side cross-sectional view of a modified thermal actuator showing modifications to reduce potential problems with lime buildup.

Several further enhancements have been developed for the thermal valve actuating element 54, which are applicable to the above-described bypass valve 16 are shown in FIG. 21. It has been noted that "lime" or "calcium" buildups on piston 80 can cause sticking of piston 80 in actuating element 54. Manufacturers of these actuating elements 54 recommend use of an elastomer boot or a nickle-teflon coating on piston 80, or use of a plastic piston 80. A preferred material may be use of a plastic piston 80, to which the buildup could not get a tenacious hold, and the removal of the internal chamfer at the open end of guide bore 244 and replacement with a sharp corner 246, as shown in FIG. 21. Removal of the chamfer and replacement with corner 246 would provide a sharper scraping edge to clean piston 80, and would eliminate a place where the detritus could become wedged. In addition to the chamfer removal, another simple geometry change to piston 80 might be very effective. As shown in FIG. 21, a long shallow groove 248 in or a reduced diameter of piston 80 that would extend from just inside guide bore 244 (at full extension) to just outside guide bore 244 at full retraction would provide a recess to contain buildup for a long period. Once this recessed area filled up with lime, edge 246 of guide bore 244 could scrape off the incrementally radially extending soft build up relatively easily, as compared to scraping off the surface layer that bonds more tenaciously to the metal.

The most direct method to overcome sticking due to mineral buildup is to optimize actuator force in both directions. Buildup of precipitated minerals on the exposed outside diameter of the extended piston 80 tends to prevent retraction, requiring a strong bias spring 56. This high bias spring force subtracts from the available extending force however, thereby limiting the force available to both extend piston 80 against the mineral sticking resistance and to effect an axial seal between poppet 78 and seat 70.

When water temperature is high, piston 80 is extended so that its surface is exposed. Deposition also occurs primarily at high temperatures, so that buildup occurs on piston 80 outside diameter, resulting in sticking in the extended position when the growth on the piston outside diameter exceeds guide 244 interior diameter. Significantly more than half of the available actuator force thus can most effectively be used to compress bias spring 56, resulting in a maximum return force.

Figure 22:
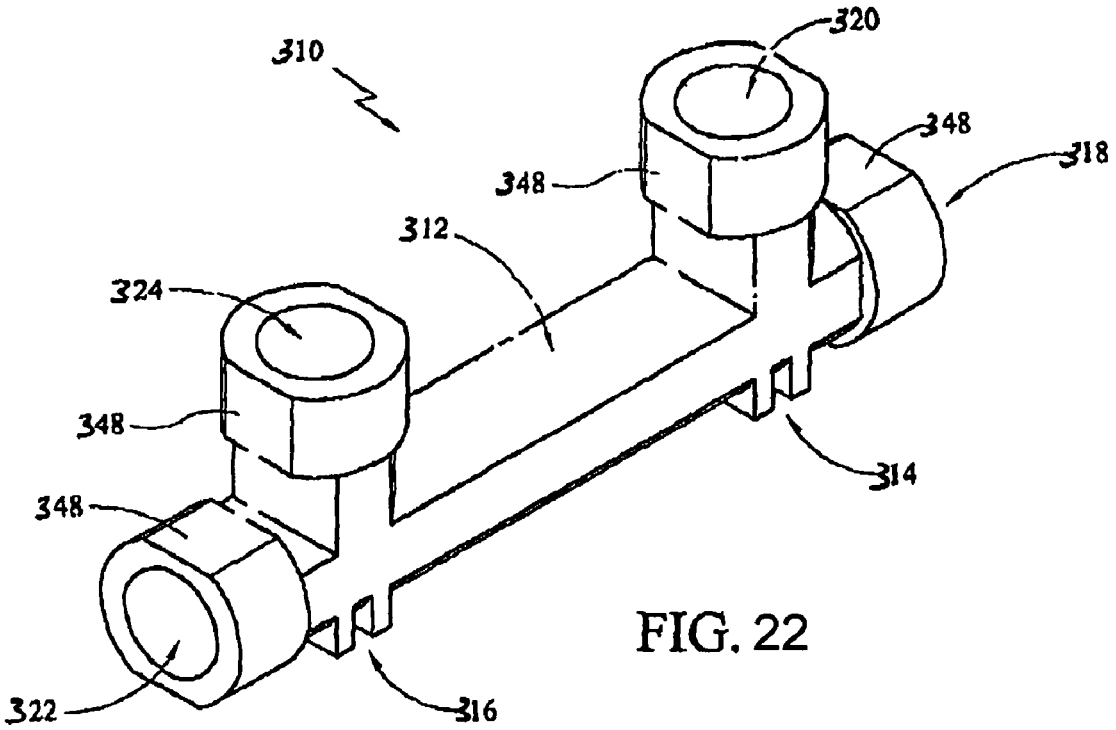
FIG. 22 is a perspective view of an assembled thermostatically controlled bypass valve utilizing an embodiment of the present invention.
Figure 23:
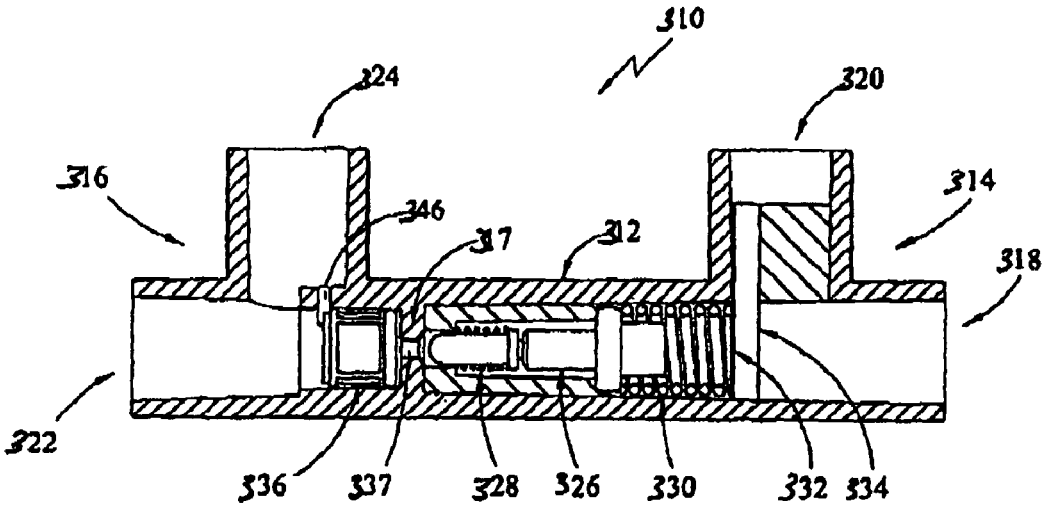
FIG. 23 is a cross-sectional side view of the bypass valve in FIG. 22.
Figure 24:
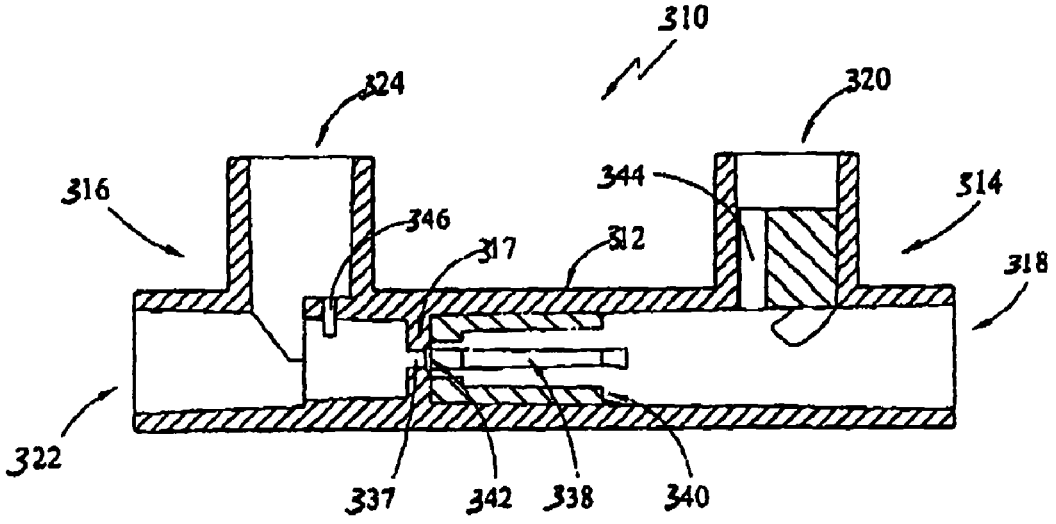
FIG. 24 is a cross-sectional side view of the valve body of the bypass valve of FIG. 22.

FIGS. 22 through 27, illustrates an embodiment of the thermostatically controlled bypass valve of the present invention is designated generally as 310. As best shown in FIGS. 22 through 24, bypass valve 310 comprises a valve body 312 having a first end 314, a second end 316 and a separating wall 317 disposed between first end 314 and second end 316. First end 314 is designated to receive and discharge hot water and second end 316 is designated to receive and discharge cold water from a source of cold water, such as a city water supply system or a local water well. Valve body 312 has four threaded ports, an axial and radial port at the first end 314 and an axial and radial port at the second end 316. For purposes of discussion herein, the axial ports are designated as inlet ports and the radial ports are designated as discharge ports, however, it will be understood from the discussion set forth below that the invention is not so limited.

At the first end 314 (the hot water side) is first inlet port 318 and first discharge port 320 and at the second end 316 (the cold water side) is second inlet port 322 and second discharge port 324. Conversely, the radial ports can be the inlet ports and the axial ports can be the discharge ports. As discussed in detail below, the first 318 and second 322 inlet ports connect to the hot and cold water distribution system and first 320 and second 324 discharge ports connect to the hot and cold water valves on the fixture (i.e., sink, shower, bathtub or etc.) with which the bypass valve 310 is utilized. The use of both an inlet 318 and discharge 320 ports on the hot side distinguish the present invention from other known bypass valves, which utilize a single port, and provide significant benefits for bypass valve 310. The bypass valve 310 reduces the number of plumbing fittings (at least one tee) and plumber time for installation by allowing it to be connected simply with swivel nut hoses. Because the "tee" function is internal to valve body 312, hot water flowing to the open fixture valve flows through valve body 312, around the thermal actuator body, allowing immediate response to rising temperature. Conversely, if the tee is an external pipe fitting remote from the thermal bypass valve, response will be slowed. This use of an integral tee shortens time in which water can be siphoned from cold to hot, eliminating the need for an internal check valve. Hot water flowing through valve body 312 to an open fixture also allows placement of a screen inside the valve body 312 such that it is swept clean. The use of the second port on the hot side also allows placement of a retaining pin without the need for an extra seal. The use of two ports on the cold side (i.e., inlet port 322 and discharge port 324) also eliminates the use of an external tee and further simplifies and reduces the cost of installing the bypass valve 310. In addition, two ports on the cold side also facilitate the use of a retaining slot for holding a check valve, if one is used.

As best shown in FIG. 23 and discussed in more detail below, valve body 312 houses a thermally sensitive actuating element 326, bias spring 328, an over-travel spring 330, screen 332, retaining pin 334 and check valve 336. Valve body 312 can most economically and effectively be manufactured out of a molded plastic material, such as Ryton-.RTM., a polyphenylene sulphide resin available from Phillips Chemical, or a variety of composites. Molded plastic materials are preferred due to their relatively high strength and chemical/corrosion resistant characteristics while providing the ability to manufacture the valve body 312 utilizing injection molding processes with the design based on the configuration described herein without the need for expensive casting or machining. Alternatively, valve body 312 can be manufactured from various plastics, reinforced plastics or metals that are suitable for "soft" plumbing loads and resistant to hot chlorinated water under pressure. As shown in FIGS. 23 and 24, first end 314 of valve body 312 is molded with wall 317 having a passage 337 therein interconnecting first end 314 and second end 316 to allow fluid to flow therethrough, a set of axially oriented fin guides 338 having ends that form an internal shoulder 340 inside valve body 312 for fixedly receiving and positioning one end of thermal actuating element 326 and the bias spring 328, and a retaining pin hole 344 for receiving retaining pin 334. Second end 316 is molded with retaining slot 346 for engagement with the snap-in check valve 336. The valve body 312 is designed so the components can fit through either of the inlet and/or discharge ports, which will typically be one-half inch diameter. In this manner, a one piece bypass valve 310 results with no intermediate or additional joints required for installation.

For ease of installation of the bypass valve 310 by the user, each of the four ports (318, 320, 322 and 324) on valve body 312 have one-half inch straight pipe threads for use with the swivel nuts that are commonly found on standard connection hoses that fit the typical residential faucet. The threads on all four ports are molded with flats or axial slots 348 interrupting the threads to prevent a user from attempting to mount valve body 312 directly to "hard" plumbing with female taper pipe threads. The swivel nuts on the connection hoses seal with hose washers against the ends of the four ports, as opposed to common pipe fittings that seal at the tapered threads. These four ports can be marked "hot in", "hot out", "cold in", and "cold out" as appropriate to provide visual indicators for the do-it-yourself installer so as to avoid confusion. In the preferred installation of bypass valve 310, inlet port 318 connects to the hot water angle stop at the wall and the discharge port 320 connects to the hot water faucet. Inlet port 322 connects to the cold water angle stop and discharge port 324 connects to the cold water faucet. In actuality, the two hot hoses can be interchanged on the two hot ports (ports 318 and 320), as can the two cold hoses on the cold ports (ports 322 and 324).

Figure 25:
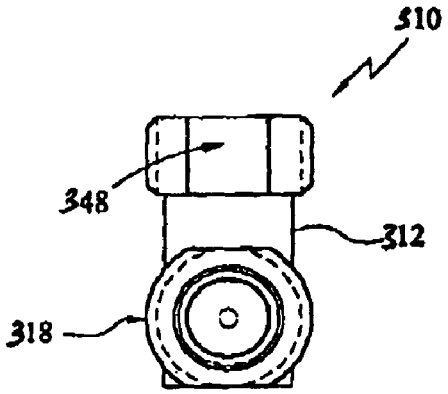
FIG. 25 is an end view of the second end of the valve body of the bypass valve of FIG. 22.
Figure 26:
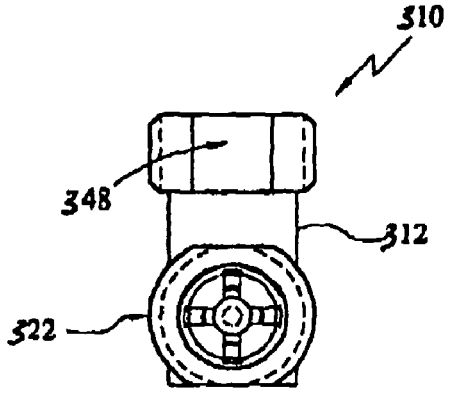
FIG. 26 is an end view of the first end of the valve body of the bypass valve of FIG. 22.
Figure 27:
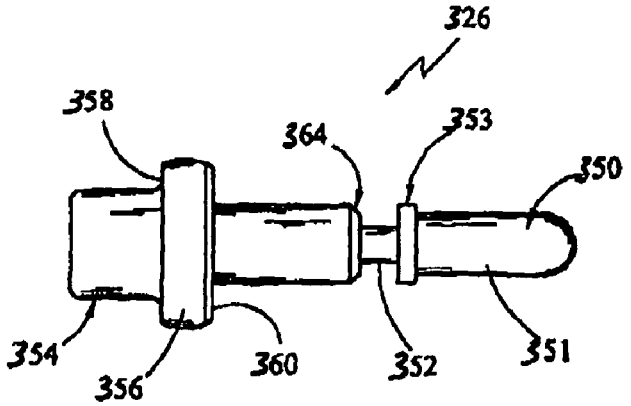
FIG. 27 is a side view of the thermally sensitive actuating element for use in the bypass valve of FIG. 22.

Thermally sensitive actuating element 326 is preferably of the wax filled cartridge type, also referred to as wax motors, having an integral piston/poppet rod member 350, as best shown in FIG. 25. Rod member 350 comprises poppet 351 attached to piston 352 with an intermediate flange 353 thereon. The end of poppet 351 seats against valve seat 342 to close passage 337. The body 354 of actuating element 326 has a section 356 of increased diameter to seat against shoulder 340 in valve body 312. As shown in FIG. 23, over-travel spring 330 abuts against first side 358 of actuator body 354 and second side 360 of actuator body abuts against shoulder 340. Piston 352 of rod member 350 interconnects poppet 351 with actuator body 354. Actuating element 326 operates in a conventional and well known manner. Briefly, actuating element 326 comprises a wax or a mixture of wax and metal powder (i.e., copper powder) enclosed in actuator body 354 by means of a membrane made of elastomer or the like. Upon heating the wax or wax with copper powder mixture slowly expands, thereby pushing piston 352 and poppet 351 of rod member 350 in an outward direction. Upon cooling, the wax or wax/copper powder mixture contracts and rod member 350 is pushed inward by bias spring 328 until flange 353 contacts actuator body 354 at actuator seat 364. Although other types of thermal actuators, such as bimetallic springs and memory alloys (i.e., Nitinol and the like) can be utilized, the wax filled cartridge type is preferred because the wax can be formulated to change from the solid to the liquid state at a particular desired temperature. The rate of expansion with respect to temperature at this change of state is many times higher, resulting in almost snap action of the wax actuating element 326. The temperature set point is equal to the preset value, such as 397 degrees Fahrenheit, desired for the hot water. This is a "sudden" large physical motion over a small temperature change. As stated above, this movement is reacted by bias spring 328, which returns rod member 350 as the temperature falls.

Although not entirely demonstrated in early tests, it is believed that beneficial "toggle" action can be achieved with a bypass valve 310 of very simple mechanical design. If the motion of the thermal actuator 326 is made to lag behind the temperature change of the water surrounding it by placing suitable insulation around the actuator 326 or by partially isolating it from the water, then instead of slowly closing only to reach equilibrium at a low flow without reaching shutoff, the water temperature will rise above the extending temperature of the insulated actuator 326 as the valve approaches shutoff, and the piston 350 will then continue to extend as the internal temperature of the actuator 326 catches up to its higher surrounding temperature, closing the valve 310 completely. It is also believed that an insulated actuator 326 will be slow opening, its motion lagging behind the temperature of the surrounding cooling-off water from which it is insulated. When actuating element 326 finally begins to open the valve 310 and allow flow, the resulting rising temperature of the surrounding water will again, due to the insulation, not immediately affect it, allowing the bypass valve 310 to stay open longer for a complete cycle of temperature rise. Such an "insulated" effect may also be accomplished by use of a wax mix that is inherently slower, such as one with less powdered copper or other thermally conductive filler. An actuator 326 to be installed with insulation can be manufactured with a somewhat lower set point temperature to make up for the lag, allowing whatever valve 310 closing temperature desired.

Also inside valve body 312 is an over-travel spring 330, disposed between the first side 358 of the actuator body 354 and a stop located inside valve body 312 to prevent damage to a fully restrained actuator 326 heated above the bypass valve's 310 maximum operating temperature and to hold the actuator 326 in place during operation without concern for normal tolerance. Over-travel spring 330 allows movement of the actuator body 354 away from the seated poppet 35.1 in the event that temperature rises substantially after the poppet 351 contacts seat 342. Without this relief, the expanding wax would distort its copper can, destroying the calibrated set point. The over-travel spring 330 also holds the bias spring 328, rod member 350 and actuator body 354 in place without the need to adjust for the stack-up of axial tolerances. Alternatively, actuator 326 can be fixedly placed inside valve body 312 by various mechanisms known in the art, including adhesives and the like. Over-travel spring can be held in place by various internal configurations commonly known in the art, such as a molded seat. In the preferred embodiment, however, over-travel spring 330 abuts against screen 332, which is held in place by cantilevered retention pin 334. Screen 332 can be a small wire fabric, mesh-type screen that is shaped and configured to fit within the first end 314 of valve body 312. Screen 332 is utilized to keep hard water lime particles and other detritus out of bypass valve 310 and to act as a seat for the over-travel spring (as explained above). Screen 332 is positioned inside valve body 312, as shown in FIG. 23, at the intersection of first inlet port 318 and first discharge port 320 so as to have its surface swept clean each time the hot water faucet is turned on. The retention pin 334 is to hold screen 332, as well as the other components, in place inside valve body 312. Retention pin 334 is installed in valve body 312 through first discharge port 320 so as to abut screen 332, thereby eliminating the need for an extra external seal.

In an alternative embodiment of the present invention, a snap-in cartridge check valve 336 is located in the second end 316 of valve body 312, as shown in FIG. 23, to prevent siphoning of cold water through the bypass valve 310 when only the hot water faucet is on, and at a high flow rate, prior to the hot water temperature rising. The preferred embodiment does not use the check valve because at very low flow rates the check valve will tend to chatter, which is a common problem with check valves.

Figure 28:
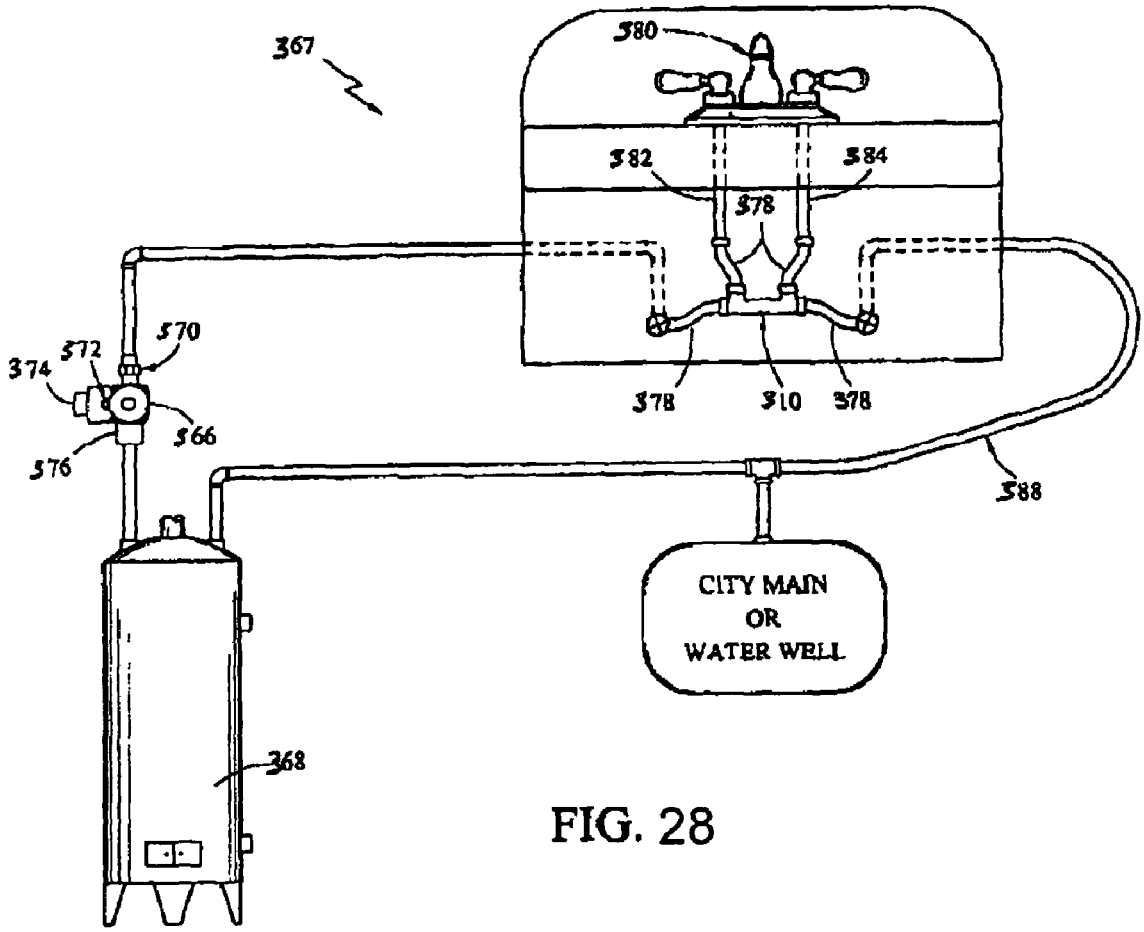
FIG. 28 is a side elevation view showing a water distribution system and fixture utilizing the bypass valve of FIG. 22

In order to achieve the desired circulation flow, a single circulating pump 366 is utilized as part of a water circulating system 367, as shown in FIG. 28. Pump 366 can be a single, small pump of the type used in residential hot water space heating. In fact, a very low flow/low head pump is desirable, as a larger (i.e., higher head/higher flow) pump mounted at the typical domestic water heater 368 tends to be noisy. This annoying noise is often transmitted by the water pipes throughout the house. In addition, if the shower (as an example) is already in use when pump 366 turns on, whether the first start or a later cyclic turn-on, the sudden pressure boost in the hot water line from a larger pump can result in an uncomfortable and possibly near-scalding temperature rise in the water at the shower head or other fixture in use. The smaller boost of a "small" pump (i.e., one with a very steep flow-head curve) will result in only a very small and less noticeable increase in shower temperature. In the preferred embodiment, the single, small pump 366 needs to provide only a flow of approximately 0.3 gpm at 1.0 psi pressure. In accordance with pump affinity laws, such a "small" pump requires a very small impeller or low shaft speed. The inventors have found that use of a very small impeller or low shaft speed also precludes formation of an air bubble in the eye of the impeller, which bubble may be a major cause of noise. Such a small steep curve pump will, however, constitute a significant pressure drop in the hot water line when several fixture taps are opened simultaneously (such as a bathtub and the kitchen sink). To avoid reduced flow, a check valve 370 can be plumbed in parallel with pump 366 or incorporated within the pump housing, to pass a flow rate exceeding the pump's capacity around pump 366. When pump 366 is powered and flow demand is low, check valve 370 prevents the boosted flow from re-circulating back to its own inlet. With check valve 370 plumbed around pump 366, it is advantageous to place an orifice 372 in the pump discharge to provide a simple manner to achieve the desired very steep flow-head curve from available stock pump designs. A single pump 366 located at or near the water heater 368 in its discharge piping will boost the pressure in the hot water pipes somewhat above that in the cold water pipes (i.e., perhaps one to three feet of boost). With this arrangement only one pump 366 per plumbing system (i.e., per water heater) is required with any reasonable number of remote faucet sets (i.e., the typical number used in residences) equipped with bypass valves 310. This is in contrast to those systems that require multiple pumps, such as a pump at each fixture where bypassing is desired.

If desired, pump 366 can operate twenty-four hours a day, with most of the time in the no flow mode. However, this is unnecessary and wasteful of electricity. Alternatively, pump 366 can have a timer 374 to turn on the pump 366 daily at one or more times during the day just before those occasions when hot water is usually needed the most (for instance for morning showers, evening cooking, etc.) and be set to operate continuously for the period during which hot water is usually desired. This still could be unnecessary and wasteful of electricity. Another alternative is to have the timer 374 cycle pump 366 on and off regularly during the period when hot water is in most demand. The "on" cycles should be of sufficient duration to bring hot water to all remote fixtures that are equipped with a bypass valve 310, and the "off" period would be set to approximate the usual time it takes the water in the lines to cool-down to minimum acceptable temperature. Yet another alternative is to equip pump 366 with a normally closed flow switch 376 sized to detect significant flows only (i.e., those flows that are much larger than the bypass valve 310 flows), such as a shower flowing. For safety purposes, the use of such a switch 376 is basically required if a cyclic timer 374 is used. The switch can be wired in series with the pump motor. If the switch indicates an existing flow at the moment the timer calls for pump on, the open flow switch will prevent the motor from starting, thereby avoiding a sudden increase in water temperature at the fixture (i.e., a shower) being utilized. The use of such a switch accomplishes several useful objectives, including reducing electrical power usage and extending pump life if hot water is already flowing and there is no need for the pump to operate, avoiding a sudden temperature rise and the likelihood of scalding that could result from the pump boost if water is being drawn from a "mixing" valve (such as a shower or single handle faucet) and allowing use of a "large" pump (now that the danger of scalding is eliminated) with its desirable low pressure drop at high faucet flows, thereby eliminating the need for the parallel check valve 370 required with a "small" pump.

By using a time-of-day control timer 374, pump 366 operates to maintain "instant hot water" only during periods of the day when it is commonly desired. During the off-cycle times, the plumbing system operates just as if the bypass valves 310 and pump 366 were not in place. This saves electrical power usage from pump operation and, more importantly, avoids the periodic introduction of hot water into relatively uninsulated pipes during the off-hours, thereby saving the cost of repeatedly reheating this water. The time-of-day control also avoids considerable wear and tear on pump 366 and the bypass valves 310. Considerable additional benefits are gained by using a cyclic timer 374, with or without the time-of-day control. In addition to saving more electricity, if a leaky bypass valve or one not having toggle action is used, there will be no circulating leakage while the pump is cycled off, even if the valve fails to shut off completely. Therefore, a simple (i.e., one not necessarily leak tight) valve may suffice in less demanding applications. Having the leakage reduced to just intermittent leakage will result in reduced warming of the cold water line and less reheating of "leaking" recirculated water. In addition, shut-off of a toggle action valve upon attainment of the desired temperature is enhanced by the differential pressure an operating pump provides. If pump 366 continues to run as the water at the bypass valve 310 cools down, the pump-produced differential pressure works against re-opening the valve. If pump 366 operates cyclically, powered only a little longer than necessary to get hot water to bypass valve 310, it will be "off" before the valve 310 cools down. When the minimum temperature is reached, the thermal actuator 326 will retract, allowing the bias spring 328 to open the valve 310 without having to fight a pump-produced differential pressure. Bypass flow will begin with the next pump "on"

cycle. An additional benefit to the use of either a time-of-day or cyclic timer 374 is that it improves the operating life of thermal actuator 326. Because use of either timer 374 causes cyclic temperature changes in valve 310 (as opposed to maintaining an equilibrium setting wherein temperature is constant and the actuator barely moves), there is frequent, substantial motion of the piston 350 in thermal actuator 326. This exercising of actuator 326 tends to prevent the build-up of hard water deposits and corrosion on the actuator piston 350 and poppet face, which deposits would render the valve 310 inoperable.

In the preferred embodiment, bypass valve 310 is manufactured from a one-piece molded valve body 312 that is configured as described above with fin guides 338, internal shoulder 340, passage 337, retaining pin hole 344 and retaining slot 346 for ease of manufacture and reduced manufacturing costs. The bias spring 328, wax cartridge actuating element 326 with its piston/poppet rod member 350, the over-travel spring 330 and screen 332 are placed into the "hot" axial port (the first inlet port 318) in that order. Screen 332 is pushed against the over-travel spring 330 compressing it, thereby making room for insertion of the retaining pin 334 through the retaining pin hole 344 at the "hot" radial port (the first discharge port 320). The cartridge check valve 336, if utilized, is inserted into the "cold" axial port (the second inlet port 322) and snaps into place in retaining slot 346.

Installation of the bypass valve 310 is also made easy by manufacturing the valve 310 in the configuration as set forth above. As discussed, valve body 312 is molded with four ports (designated as 318, 320, 322 and 324).to allow installation with commonly used under-sink (as an example) vinyl hoses or flexible metal pipe, shown as 378 in FIG. 28, having swivel ends and faucet washers. The inlet ports 318 and 322 on valve body 312 are formed with one-half inch straight pipe threads to allow the installer to remove the end of the wall shut off-to-faucet hoses (hot and cold) at the faucet 380 and connect those ends, which are commonly one-half inch straight pipe threads, to valve inlets 318 and 322. The valve discharge ports 320 and 324 are likewise molded with one-half inch straight pipe threads to allow connection from them to the hot 382 and cold 384 inlets at faucet 380. The threads on all four ports will seal only with hose washers and swivel nuts. Because the use of a plastic valve body 312 is envisioned, the inability to mount valve body 312 directly to "hard" plumbing with taper pipe threads insures that the body 312 will be connected only with flexible lines 378, thereby precluding any plumbing loads that might overstress the non-metallic body. Because all current American faucets 380 are equipped with one-half inch straight pipe threads, the recommended procedure is to remove the pair of existing connection hoses 378 from the faucet 380 and connect these loose ends to the appropriate inlet ports 318 and 322 of valve body 312. The angle stop valves at the wall may have any of several possible thread size connections, or may have permanently connected hoses or tubes. As a result, it is best not to disturb these wall connections, but instead use hoses 378 to connect from the angle stop to bypass valve 310. A new set of hoses 378 with one-half inch straight pipe thread swivel nuts at both ends can then be connected from discharge ports 320 and 324 of valve body 312 to the appropriate hot 382 and cold 384 water connections on faucet 380.

The operation of the bypass valve 310 is summarized on the chart shown as FIG. 20, which indicates the results of the twenty combinations of conditions (pump on/pump off; hot water line hot/hot water line cooled off; hot faucet on, or off, or between; cold faucet on or off, or between) that are applicable to the operation of valve 310. The operating modes IVB, IVC, IVD, IIIB, & IIID are summarized detailed in the immediately following text. The operation of the remaining fifteen modes are relatively more obvious, and may be understood from the abbreviated indications in the outline summarizing FIG. 20. Starting with the set "off" hours (normal sleeping time, and daytime when no one is usually at home) pump 366 will not be powered. Everything will be just as if there were no pump 366 and no bypass valve 310 installed (i.e., both the cold and hot water lines will be at the same (city water) pressure). The hot water line and bypass valve 310 will have cooled off during the long interim since the last use of hot water. The reduced temperature in the valve results in "retraction" of rod member 350 of the thermally sensitive actuator 326. The force of bias spring 328 pushing against flange 353 on rod member 350 will push it back away from valve seat 342, opening valve 310 for recirculation. Although the thermal actuating element 326 is open, with pump 366 not running, no circulation flow results, as the hot 386 and cold-388 water piping systems are at the same pressure. This is the mode indicated as IVB in the outline on FIG. 20. If the cold water valve at faucet 380 is opened with the thermal element 326 open as in mode IVB above, pressure in the line 388 to the cold water side of faucet 380 will drop below the pressure in the hot water line 386. This differential pressure will siphon tepid water away from the hot side to the cold side, which is the mode indicated as IVD in the outline on FIG. 20. The recirculation will end when the tepid water is exhausted from the hot water line 386 and the rising temperature of the incoming "hot" water causes the thermal element 326 to close.

If the hot water valve is turned on with the thermal element 326 open as in mode IVB above, pressure in the line 386 to the hot water side of faucet 380 will drop below the pressure in the cold water line 388. This differential pressure, higher on the cold side, will load check valve 336 in the "closed" direction allowing no cross flow. This is mode IVC in the outline on FIG. 20. In this mode, with the hot water line 386 cooled and the pump off, a good deal of cooled-off water will have to be run oust as if valve 310 were not installed), to get hot water, at which time the thermal element 326 will close without effect, and without notice by the user. With the thermal element 326 open and the hot water line 386 cooled-off as in mode IVB above, at the preset time of day (or when the cyclic timer trips the next "on" cycle) the pump 366 turns on, pressurizing the water in the hot side of valve 310. Pump pressure on the hot side of valve 310 results in flow through the open thermal element 326, thereby pressurizing and deflecting the check valve 336 poppet away from its seat to an open position. Cooled-off water at the boosted pressure will thus circulate from the hot line 386 through the thermal element 326 and check valve 336 to the lower pressure cold line 388 and back to water heater 368. This is the primary "working mode" of the bypass valve 310 and is the mode indicated as 111*b* in the outline on FIG. 20. If the cold water valve is turned on during the conditions indicated in mode IIIB above (i.e., pump 366 operating, hot line 386 cooled off, both the hot and cold valves at faucet 380 off) and while the desired recirculation is occurring, mode IIID will occur. A pressure drop in the cold water line 388 due to cold water flow creates a pressure differential across valve 310 in addition to the differential created by pump 366. This allows tepid water to more rapidly bypass to the cold water inlet 384 at faucet 380.

When the tepid water is exhausted from the hot water line 386, thermal element 326 will close, ending recirculation.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A water pump and bypass valve sub-system for use in a water circulating system, the sub-system comprising:

a thermostatically controlled bypass valve configured to be located proximate a fixture in the water circulating system, the valve comprising:

a housing having a hot water port and a cold water port formed integral with one another as part of a one-piece body, the hot water port being configured to be joined directly to a hot water supply line, the cold water port being configured to be joined directly to a cold water supply line, the housing having a passage permitting recirculating flow between the hot and cold water ports;

a thermally sensitive actuating member, disposed within the housing, the thermally sensitive actuating member extending when heated above a preset temperature value and contracting when cooled below the preset temperature value, the thermally sensitive actuating member opening and closing the passage based on a temperature of the thermally sensitive actuating member; and a water pump configured to be located in the water circulation system remote from the fixture, the pump being configured to pump water through the water circulating system to the bypass valve.

2. The sub-system of claim 1, wherein the hot and cold water ports are threaded with standard pipe threading to facilitate direct connection to flexible hoses that form part of the hot and cold water supply lines, respectively.

3. The sub-system of claim 1, wherein the hot water port includes a hot inlet port and a hot discharge port located proximate to and integral with one another, the hot inlet port being configured to receive hot water, the hot discharge port being configured to discharge the hot water, the cold water port and the hot inlet and discharge ports being formed integral with one another as part of the one-piece body.

4. The sub-system of claim 1, wherein the cold water port includes a cold inlet port and a cold discharge port located proximate to one another, the cold inlet port being configured to receive cold water, the cold discharge port being configured to discharge the cold water, the hot water port and the cold inlet and discharge ports being formed integral with one another as part of the one-piece body.

5. The sub-system of 1, further comprising a check valve connected in parallel with the pump, the check valve being configured to permit water to bypass the pump when a flow rate of the water circulating system exceeds a capacity of the pump.

6. The sub-system of claim 5, wherein the check valve is incorporated within a housing of the pump.

7. The sub-system of claim 1, further comprising a screen held within the housing proximate the hot water port.

8. The sub-system of claim 1, wherein the bypass valve further comprises a bias spring disposed in the housing, the bias spring engaging the thermally sensitive actuating member and urging the thermally sensitive actuating member to contract.

9. The sub-system of claim 1, further comprising an over-travel spring disposed within the housing, the over-travel spring allowing movement of the thermally sensitive actuating member.

10. The sub-system of claim 1, wherein the housing includes an integral metal body with first and second ends, the first end including the hot water port, the second end including the cold water port, the first and second ends being cast in the one-piece body.

11. The sub-system of claim 1, wherein the thermally sensitive actuating member includes an actuating element having a body and a piston extending and contracting relative to one another as the thermally sensitive actuating member heats and cools, respectively.

12. The sub-system of claim 1, wherein the thermally sensitive actuating member includes a poppet located proximate an opening of the passage, the poppet seating against, and unseating from, the opening of the passage when the thermally sensitive actuating member extends and contracts, respectively.

13. The sub-system of claim 1, wherein the thermally sensitive member includes a body having one of a wax filled cartridge, a bimetallic spring, and a memory alloy.

14. The sub-system of claim 1, wherein the housing is made from one of plastic and metal.

15. The sub-system of claim 1, wherein the pump is mounted proximate one of an inlet and outlet of the hot water heater.

16. The sub-system of claim 1, further comprising a control timer that turns the pump on and off at predetermined times of day.

17. The sub-system of claim 1, further comprising a control timer that turns the pump on and off, the control timer being adjustable by a user to direct the pump to cycle on and off regularly during a period in which hot water is desired.

18. The sub-system of claim 1, further comprising a control timer that turns the pump on and off, the control timer being adjustable by a user to direct the pump to operate continuously for a period during which hot water is desired.

19. The sub-system of claim 1, further comprising a normally closed flow switch that monitors a flow through the water circulating system, the flow switch preventing the pump from turning on when the flow is larger than a maximum flow permitted through the bypass valve.

20. The sub-system of claim 1, wherein housing includes a chamber having an open end, the thermally sensitive actuating member being loaded into the chamber through the open end and held in the chamber with a retention member.

21. A water pump and bypass valve sub-system for use in a water circulating system, the sub-system comprising:

a thermostatically controlled bypass valve configured to be located proximate a fixture in the water circulating system, the valve comprising:

a housing having a hot water port and a cold water port formed integral with one another, the hot water port being configured to communicate with a hot water supply line, the cold water port being configured to communicate with a cold water supply line, the housing having a passage permitting recirculating flow between the hot and cold water ports;

a thermally sensitive actuating member, disposed within the housing, the thermally sensitive actuating member extending when heated above a preset temperature value and contracting when cooled below the preset temperature value, the thermally sensitive actuating member opening and closing the passage based on a temperature of the thermally sensitive actuating member;

a water pump configured to be located in the water circulation system remote from the fixture, the pump being configured to pump water through the water circulating system to the bypass valve; and a check valve connected in parallel with the pump, the check valve being configured to permit water to bypass the pump when a flow rate of the water circulating system exceeds a capacity of the pump.

22. The sub-system of claim 21, wherein the check valve is incorporated within a housing of the pump.

23. The sub-system of claim 21, wherein the hot and cold water ports are threaded with standard pipe threading to facilitate direct connection to flexible hoses that form part of the hot and cold water supply lines, respectively.

24. The sub-system of claim 21, wherein the hot water port includes a hot inlet port and a hot discharge port located proximate to and integral with one another, the hot inlet port being configured to receive hot water, the hot discharge port being configured to discharge the hot water, the cold water port and the hot inlet and discharge ports being formed integral with one another as part of a one-piece body.

25. The sub-system of claim 21, wherein the cold water port includes a cold inlet port and a cold discharge port located proximate to one another, the cold inlet port being configured to receive cold water, the cold discharge port being configured to discharge the cold water, the hot water port and the cold inlet and discharge ports being formed integral with one another as part of a one-piece body.

26. The sub-system of claim 21, further comprising a screen held within the housing proximate the hot water port.

27. The sub-system of claim 21, wherein the bypass valve further comprises a bias spring disposed in the housing, the bias spring engaging the thermally sensitive actuating member and urging the thermally sensitive actuating member to contract.

28. The sub-system of claim 21, further comprising an over-travel spring disposed within the housing, the over-travel spring allowing movement of the thermally sensitive actuating member.

29. The sub-system of claim 21, further comprising a control timer that turns the pump on and off at predetermined times of day.

30. The sub-system of claim 21, wherein the thermally sensitive actuating member includes a thermal actuator surrounded by insulation.

31. A water pump and bypass valve sub-system for use in a water circulating system, the sub-system comprising:

a thermostatically controlled bypass valve configured to be located proximate a fixture in the water circulating system, the valve comprising:

a housing having a hot water port and a cold water port, the hot water port being configured to communicate with a hot water supply line, the cold water port being configured to communicate with a cold water supply line, the housing having a passage permitting recirculating flow between the hot and cold water ports;

a screen held within the housing proximate the hot water port; and a thermally sensitive actuating member, disposed within the housing, the thermally sensitive actuating member extending when heated above a preset temperature value and contracting when cooled below the preset temperature value, the thermally sensitive actuating member opening and closing the passage based on a temperature of the thermally sensitive actuating member; and a water pump configured to be located in the water circulation system remote from the fixture, the pump being configured to pump water through the water circulating system to the bypass valve.

32. The sub-system of claim 31, wherein the hot and cold water ports are threaded with standard pipe threading to facilitate direct connection to flexible hoses that form part of the hot and cold water supply lines, respectively.

33. The sub-system of claim 31, wherein the hot water port includes a hot inlet port and a hot discharge port located proximate to and integral with one another, the hot inlet port being configured to receive hot water, the hot discharge port being configured to discharge the hot water, the cold water port and the hot inlet and discharge ports being formed integral with one another as part of a one-piece body.

34. The sub-system of claim 31, wherein the cold water port includes a cold inlet port and a cold discharge port located proximate to one another, the cold inlet port being configured to receive cold water, the cold discharge port being configured to discharge the cold water, the hot water port and the cold inlet and discharge ports being formed integral with one another as part of a one-piece body.

35. The sub-system of 31, further comprising a check valve connected in parallel with the pump, the check valve being configured to permit water to bypass the pump when a flow rate of the water circulating system exceeds a capacity of the pump.

36. The sub-system of claim 31, wherein the check valve is incorporated within a housing of the pump.

37. The sub-system of claim 31, wherein the bypass valve further comprises a bias spring disposed in the housing, the bias spring engaging the thermally sensitive actuating member and urging the thermally sensitive actuating member to contract.

38. The sub-system of claim 31, further comprising an over-travel spring disposed within the housing, the over-travel spring allowing movement of the thermally sensitive actuating member.

39. The sub-system of claim 31, further comprising a control timer that turns the pump on and off at predetermined times of day.

40. The sub-system of claim 31, wherein the thermally sensitive actuating member includes a thermal actuator surrounded by insulation.

* * * * *